US006828880B2

(12) United States Patent
Kundu

(10) Patent No.: US 6,828,880 B2
(45) Date of Patent: Dec. 7, 2004

(54) BANDPASS FILTER

(75) Inventor: Arun Chandra Kundu, Phoenix, AZ (US)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/236,416

(22) Filed: Sep. 6, 2002

(65) Prior Publication Data

US 2003/0062972 A1 Apr. 3, 2003

(30) Foreign Application Priority Data

Sep. 10, 2001 (JP) ..... 2001-273882

(51) Int. Cl.[7] ..... H01P 1/20
(52) U.S. Cl. ..... 333/202; 333/210
(58) Field of Search ..... 333/202, 134, 333/204, 206, 210; 343/768, 776

(56) References Cited

U.S. PATENT DOCUMENTS

| | | | | |
|---|---|---|---|---|
| 3,621,483 A | * | 11/1971 | Craven | 333/210 |
| 3,825,932 A | * | 7/1974 | Hockham | 343/776 |
| 3,848,256 A | * | 11/1974 | Craven et al. | 343/768 |
| 4,675,631 A | * | 6/1987 | Waggett | 333/210 |
| 4,837,535 A | | 6/1989 | Konishi et al. | 333/210 |
| 5,010,309 A | | 4/1991 | Manssen et al. | 333/206 |
| 5,929,725 A | | 7/1999 | Toda et al. | 333/202 |
| 6,002,306 A | | 12/1999 | Arakawa | 333/134 |
| 6,166,612 A | | 12/2000 | Tsujiguchi | 333/204 |
| 6,563,402 B2 | | 5/2003 | Kundu | |
| 6,570,473 B2 | * | 5/2003 | Endo et al. | 333/206 |
| 6,621,381 B1 | | 9/2003 | Kundu et al. | |
| 6,661,314 B2 | * | 12/2003 | Kundu | 333/210 |

FOREIGN PATENT DOCUMENTS

| | | | |
|---|---|---|---|
| EP | 1 024 548 A1 | | 8/2000 |
| EP | 1 213 785 A1 | | 6/2002 |
| EP | 1 244 171 A1 | | 9/2002 |
| EP | 1 286 410 A2 | | 2/2003 |
| EP | 1300906 | * | 4/2003 |
| JP | 2000-068711 | | 3/2000 |
| JP | 2000114812 | | 4/2000 |
| JP | 2000-183616 | | 6/2000 |

OTHER PUBLICATIONS

Kubo, H. et al., "Design and Fabrication of Band Pass Filters Based on a Dielectric E –Plane Waveguide," *IEEE MTT–S International Microwave Symposium Digest I*:241–244, May 23, 1994.

Konishi, Y., "Novel Dielectric Waveguide Components–Microwave Applications of New Ceramic Materials," *Proceedings of the IEEE 79*(6);726–740, Jun. 1991.

(List continued on next page.)

*Primary Examiner*—Patrick Wamsley
(74) *Attorney, Agent, or Firm*—Seed IP Law Group PLLC

(57) ABSTRACT

A highly compact band pass filter that has excellent mechanical strength is disclosed. A band pass filter according to the present invention employs a dielectric block of substantially rectangular prismatic shape constituted of a first portion lying between a first cross-section of the dielectric block and a second cross-section of the dielectric block substantially parallel to the first cross-section and second and third portions divided by the first portion and metal plates formed on surfaces of the dielectric block. The first portion of the dielectric block and the metal plates formed thereon are enabled to act as an evanescent waveguide. The second portion of the dielectric block and the metal plates formed thereon are enabled to act as a first resonator. The third portion of the dielectric block and the metal plates formed thereon are enabled to act as a second resonator. The metal plates include at least one exciting electrode formed on a first surface of the dielectric block which has the widest area. Thus a wide band characteristics can be obtained whereas the very thin dielectric block is used. Further, a high unloaded quality factor ($Q_0$) can be obtained because the radiation loss is lowered when the thickness of the dielectric block is reduced.

18 Claims, 14 Drawing Sheets

OTHER PUBLICATIONS

Kundu, A. et al., "TEM–Mode Planar Dielectric Waveguide Resonator BPF for W–CDMA," in *Proceedings of the 2000 IEEE MTT–S International Microwave Symposium–Digest*, Boston, MA, Jun. 11–16, 2000, pp. 191–194.

Kundu, A. C. et al., "TEM–Mode Planar Dielectric Waveguide Resonator BPF for W–CDMA," *2000 IEEE MTT–S Digest*, pp. 191–194.

Awai, I. et al., "Distributed Coupling of Dual–Modes in a Circular Resonator and Low–Profile Dielectric Disk Resonator BPF," *IEICE Transactions on Electronics*, vol. E82–C No. 2, Feb. 1999, pp. 393–401.

Konishi, Y., "Novel Dielectric Waveguide Components–Microwave Applications of New Ceramic Materials," *Proceedings of the IEEE*, vol. 79, No. 6, Jun. 1991, pp. 726–740.

Hwang, H. Y. et al., "A Novel $TE_{108}$ Rectangular Waveguide Resonator and Its Bandpass Filter applications," *Dept. of electronics Engineering, Sogang University*, pp. 86–89.

* cited by examiner

BANDPASS FILTER

BACKGROUND OF THE INVENTION

The present invention relates to a bandpass filter, and particularly, to a highly compact bandpass filter that has excellent mechanical strength.

DESCRIPTION OF THE PRIOR ART

In recent years, marked advances in miniaturization of communication terminals, typically mobile phones, has been achieved thanks to miniaturization of the various components incorporated therein. One of the most important components incorporated in a communication terminal is a filter component.

As one type of filter component, Japanese Patent Laid Open No. 2000-68711 and Japanese Patent Laid Open No. 2000-183616, for example, each bandpass filters comprising a dielectric block formed with a plurality of holes whose inner walls are coated with metal plates. As another type of filter component, bandpass filters constituted by forming metal plates on irregular surfaces of a dielectric block are described in "Novel Dielectric Waveguide Components—Microwave Applications of New Ceramic Materials (PROCEEDINGS OF THE IEEE, VOL.79, NO.6, JUNE 1991), p734, FIG. 31."

As a need continues to be felt for still further miniaturization of communication terminals such as mobile phones, further miniaturization of filter components, e.g., bandpass filters, incorporated therein is also required.

The mechanical strength of the above-mentioned types of filter components is, however, low because holes are formed in, or irregularities are formed on, the dielectric block constituting the main body. Miniaturization of the filter component is therefore impossible. Specifically, in the former type of filter component having holes formed in a dielectric block, mechanical strength of the dielectric block is low around the holes and in the latter type of filter component having irregularities formed on the surface of a dielectric block, mechanical strength is low around the recesses. Therefore, miniaturization of the filter component must be limited to ensure the mechanical strength at such portions.

Thus, in the prior art it is difficult to miniaturize filter components while ensuring sufficient mechanical strength. Therefore, a compact bandpass filter that has excellent mechanical strength is desired.

SUMMARY OF THE INVENTION

It is therefore an object of the present invention to provide a compact bandpass filter having excellent mechanical strength.

The above and other objects of the present invention can be accomplished by a bandpass filter comprising a dielectric block constituted of a first portion lying between a first cross-section of the dielectric block and a second cross-section of the dielectric block substantially parallel to the first cross-section and second and third portions divided by the first portion and metal plates formed on surfaces of the dielectric block, thereby enabling the first portion of the dielectric block and the metal plates formed thereon to act as an evanescent waveguide, the second portion of the dielectric block and the metal plates formed thereon to act as a first resonator, and the third portion of the dielectric block and the metal plates formed thereon to act as a second resonator, the metal plates including at least one exciting electrode formed on a first surface of the dielectric block, which has the widest area.

According to this aspect of the present invention, because the exciting electrode is formed on the first surface of the dielectric block, which has the widest area, a wide band characteristic can be obtained while using a very thin dielectric block. Further, when a very thin dielectric block is used, a high unloaded quality factor ($Q_0$) can be obtained because the radiation loss is reduced.

In a preferred aspect of the present invention, substantially all of surfaces of the dielectric block substantially parallel to the first cross-section are open ends.

According to this preferred aspect of the present invention, because it is not necessary to form any metal plate or exciting electrode on the surfaces substantially parallel to the first cross-section, the fabrication cost can be reduced.

In a further preferred aspect of the present invention, the dielectric block has a substantially rectangular prismatic shape.

According to this preferred aspect of the present invention, because the dielectric block has a substantially rectangular prismatic shape, its mechanical strength becomes very high. Therefore, highly compact size and excellent mechanical strength can be obtained.

In a further preferred aspect of the present invention, exciting electrodes are formed on a corner or its adjacent region of the first surface of the dielectric block.

The above and other objects of the present invention can be also accomplished by a bandpass filter comprising:

- a dielectric block having a top surface, a bottom surface, first and second side surfaces opposite to each other and third and fourth side surfaces opposite to each other, the dielectric block being constituted of a first portion lying between a first cross-section of the dielectric block substantially parallel to the first side surface and a second cross-section of the dielectric block substantially parallel to the first cross-section, a second portion lying between the first side surface and the first cross-section, and a third portion lying between the second side surface and the second cross-section;
- a first metal plate formed on the top surface of the dielectric block corresponding to the second portion;
- a second metal plate formed on the top surface of the dielectric block corresponding to the third portion;
- a third metal plate formed on the third side surface of the dielectric block corresponding to the second portion;
- a fourth metal plate formed on the third side surface of the dielectric block corresponding to the third portion;
- a fifth metal plate formed on the bottom surface of the dielectric block;
- a first exciting electrode formed on the bottom surface of the dielectric block corresponding to the second portion; and
- a second exciting electrode formed on the bottom surface of the dielectric block corresponding to the third portion.

According to this aspect of the present invention, because the exciting electrodes are formed on the bottom surface of the dielectric block, a wide band characteristic can be obtained by thinning the dielectric block.

In a preferred aspect of the present invention, substantially all of the first and second side surfaces of the dielectric block are open ends.

In a further preferred aspect of the present invention, the bandpass filter further comprises a third exciting electrode formed on the fourth side surface of the dielectric block corresponding to the second portion and a fourth exciting electrode formed on the fourth side surface of the dielectric block corresponding to the third portion, the first and third exciting electrodes being in contact with each other and the second and fourth exciting electrodes being in contact with each other.

According to this preferred aspect of the present invention, because the external coupling is enhanced, still wider bandwidth can be obtained and the radiation loss can be reduced.

In a further preferred aspect of the present invention, the bandpass filter further comprises a capacitive stub formed on the fourth side surface of the dielectric block corresponding to at least the second and third portions.

According to this preferred aspect of the present invention, the overall size of the bandpass filter can be reduced.

In a further preferred aspect of the present invention, the fifth metal plate is in contact with the capacitive stub.

According to this preferred aspect of the present invention, because the effect of the capacitive stub is enhanced, the overall size of the bandpass filter can be further reduced.

In a further preferred aspect of the present invention, substantially all of the fourth side surface of the dielectric block is an open end.

According to this preferred aspect of the present invention, because it is not necessary to form a metal plate on the fourth side surface of the dielectric block, the fabrication cost can be reduced.

In a further preferred aspect of the present invention, a portion of the fifth metal plate formed on the surface of the second portion of the dielectric block and another portion of the fifth metal plate formed on the surface of the third portion of the dielectric block have the same dimensions.

In a further preferred aspect of the present invention, the dielectric block has a substantially rectangular prismatic shape.

In a further preferred aspect of the present invention, the second portion of the dielectric block, the first metal plate, the third metal plate, and a portion of the fifth metal plate formed on the surface of the second portion of the dielectric block are enabled to act as a first quarter-wave dielectric resonator and the third portion of the dielectric block, the second metal plate, the fourth metal plate, and another portion of the fifth metal plate formed on the surface of the third portion of the dielectric block are enabled to act as a second quarter-wave dielectric resonator.

The above and other objects of the present invention can be also accomplished by a bandpass filter, comprising:

- a plurality of quarter-wave dielectric resonators including at least first and second quarter-wave dielectric resonators located in line, each of which is constituted of metal plates formed on a first surface of a dielectric block, a second surface of the dielectric block opposite to the first surface, and a third surface of the dielectric block substantially perpendicular to the first surface;
- an evanescent waveguide interposed between adjacent quarter-wave dielectric resonators;
- a first exciting electrode formed on the second surface of a portion of the dielectric block corresponding to the first quarter-wave dielectric resonator; and
- a second exciting electrode formed on the second surface of another portion of the dielectric block corresponding to the second quarter-wave dielectric resonator.

In a preferred aspect of the present invention, a direct coupling is provided between the first and second exciting electrodes.

In a further preferred aspect of the present invention, the bandpass filter is substantially a rectangular prism in overall shape.

In a further preferred aspect of the present invention, substantially all of surfaces of the dielectric block perpendicular to both the first and third surfaces are open ends.

In a further preferred aspect of the present invention, the bandpass filter further comprises a capacitive stub formed on a surface of the dielectric block opposite to the third surface.

The above and other objects and features of the present invention will become apparent from the following description made with reference to the accompanying drawings.

DESCRIPTION OF THE PREFERRED EMBODIMENT

Preferred embodiments of the present invention will now be explained with reference to the drawings.

Figure 1:
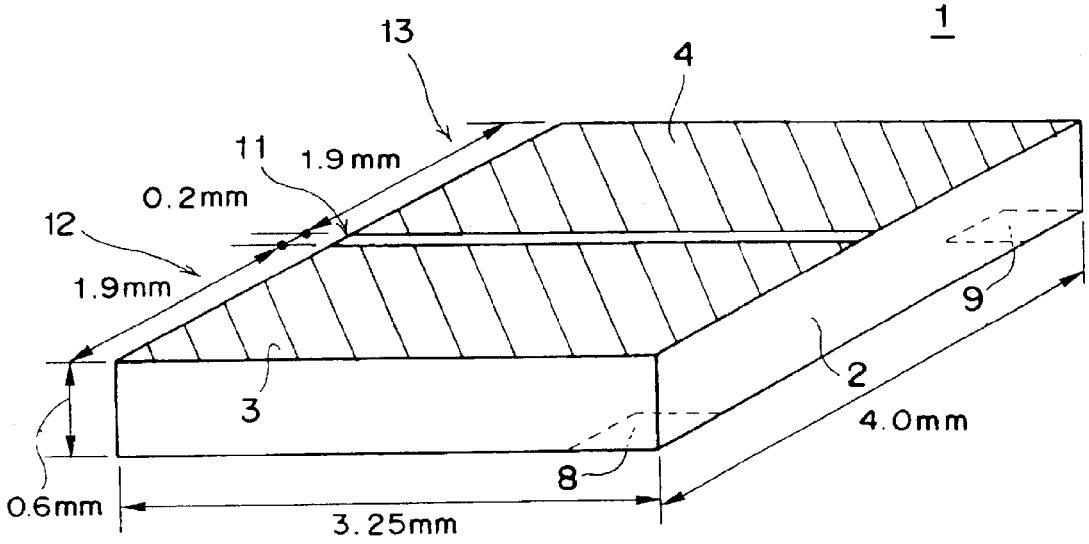
FIG. 1 is a schematic perspective view from the top side showing a bandpass filter 1 that is a preferred embodiment of the present invention.
Figure 2:
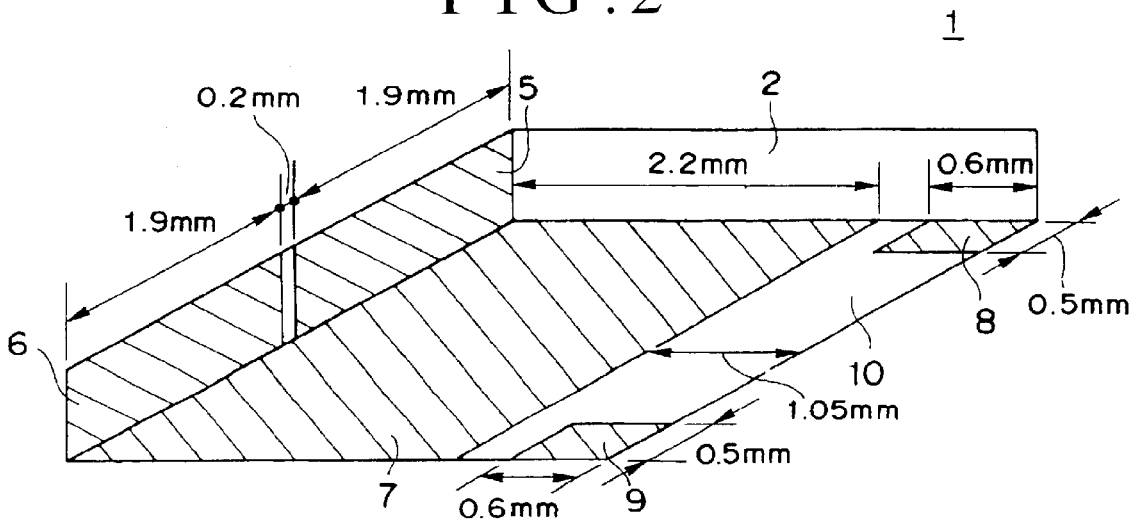
FIG. 2 is a schematic perspective view from the bottom side showing the bandpass filter 1 of FIG. 1.

As shown in FIGS. 1 and 2, a bandpass filter 1 that is a preferred embodiment of the present invention is constituted of a dielectric block 2 and various metal plates formed on the surface thereof. The dielectric block 2 is made of dielectric material whose dielectric constant $\epsilon_r$ is 33, for example, and has the shape of a rectangular prism whose length, width, and thickness are 4.0 mm, 3.25 mm, and 0.6 mm. That is, the dielectric block 2 has no holes or surface irregularities.

Further, the dielectric block 2 is composed of a first portion lying between a first cross-section and a second cross-section parallel to the first cross-section and second and third portions divided by the first portion. It is worth noting that this does not mean that the dielectric block 2 is a combination of the first to third portions of physically different components. The dielectric block 2 constitutes a single dielectric unit, i.e., the first to third portions are names used solely for convenience of description.

The first portion of the dielectric block 2, whose length, width, and thickness are 0.2 mm, 3.25 mm, and 0.6 mm, is located at the center of the rectangular prismatic dielectric block 2. The second and third portions of the dielectric block 2 are symmetrically located relative to the first portion. Each measures 1.9 mm, 3.25 mm, and 0.6 mm in length, width and thickness. Directions defining the "length," "width," and "thickness" of the first to third portions are the same as the directions defining the "length," "width," and "thickness" of the dielectric block 2.

The dielectric block 2 has a top surface, a bottom surface, and four side surfaces. Among the four side surfaces of the dielectric block 2, the end surface of the second portion is defined as a "first side surface," end surface of the third portion is defined as a "second side surface," and the remaining surfaces are defined as a "third side surface" and a "fourth side surface." Therefore, both the top and bottom surfaces measure 4.0 mm (length)×3.25 mm (width), both the first and second side surfaces measure 0.6 mm (thickness)×3.25 mm (width), and both the third and fourth side surfaces measure 4.0 mm (length)×0.6 mm (thickness).

As shown in FIGS. 1 and 2, metal plates 3 and 4 are formed on the top surface of the dielectric block 2 corresponding to the entire second and third portions, respectively; metal plates 5 and 6 are formed on the third side surface of the dielectric block 2 corresponding to the entire second and third portions, respectively; a metal plate 7, whose length and width are 4.0 mm and 2.2 mm, is formed on the bottom surface of the dielectric block 2; and exciting electrodes 8 and 9, whose length and width are 0.5 mm and 0.6 mm, are formed on the bottom surface of the dielectric block 2. The metal plate 7 and the exciting electrodes 8 and 9 are prevented from being in contact with one another by clearance a portion 10. As shown in FIG. 2, the metal plate 7 has a rectangular shape with one of its long sides coincident with the side of the bottom surface close to the third side surface and each short side is coincident with the side of the bottom surface close to the first and second side surfaces, respectively. The exciting electrode 8 is located at the corner of the bottom surface of the dielectric block 2 close to the first and fourth side surfaces. The exciting electrode 9 is located at the corner of the bottom surface of the dielectric block 2 close to the second and fourth side surfaces.

The metal plate 5 is in contact with the metal plates 4 and 7. The metal plate 6 is in contact with the metal plates 3 and 7. That is, these metal plates 3–7 are short-circuited to one another and grounded. One of the exciting electrodes 8 and 9 is used as an input electrode, and the other is used as an output electrode.

The metal plates 3–7 and the exciting electrodes 8 and 9 are made of silver. However, the present invention is not limited to using silver and other kinds of metal can be used instead. It is preferable to use a screen printing method to form them on the surfaces of the dielectric block 2.

No metal plate or electrode is formed on the remaining surfaces of the dielectric block 2, which therefore constitute open ends. Since the bandpass filter 1 does not require any metal plate or electrode to be formed on the first, second and fourth side surfaces of the dielectric block 2, metallization for only the top, bottom and third side surfaces of the dielectric block 2 is required during fabrication of the bandpass filter 1.

According to the above described structure, the first portion of the dielectric block 2 and the metal plate formed thereon act as an evanescent waveguide 11, the second portion of the dielectric block 2 and the metal plate formed thereon act as a first resonator 12, and the third portion of the dielectric block 2 and the metal plate formed thereon act as a second resonator 13. The evanescent waveguide 11 is an E-mode waveguide, and each of the first and second resonators 12 and 13 is a quarter-wave (λ/4) dielectric resonator.

The principle of the quarter-wave (λ/4) dielectric resonators constituted by the first resonator 12 and the second resonator 13 will now be explained.

Figure 3:
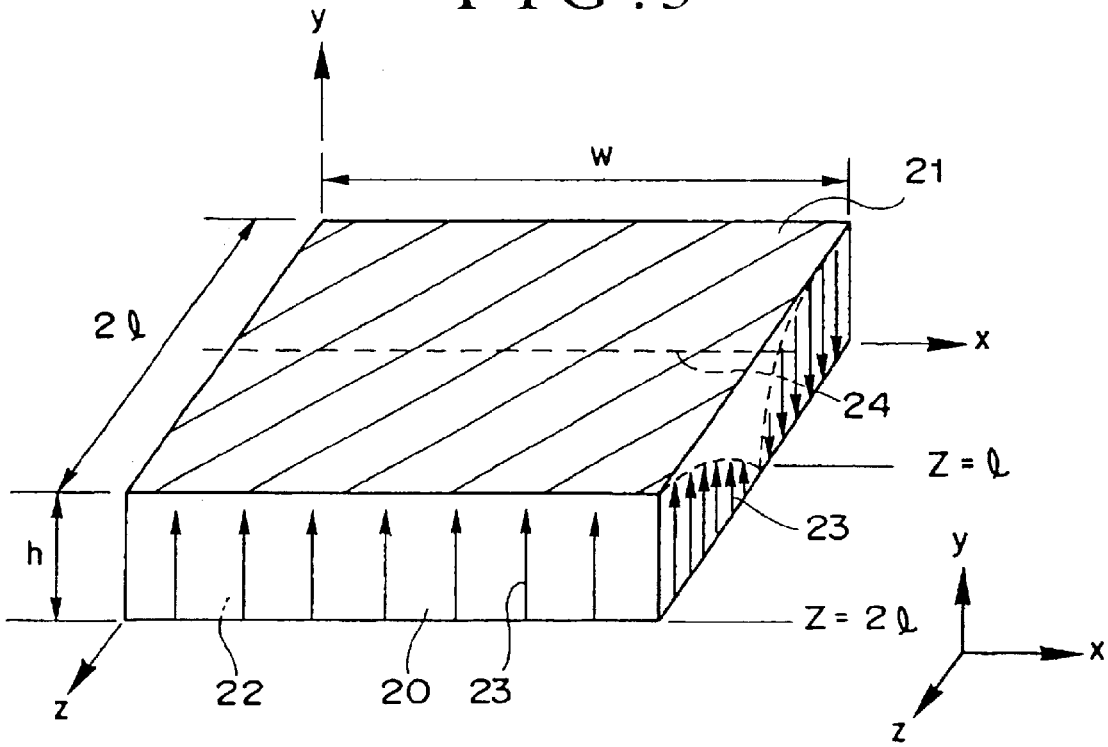
FIG. 3 is a schematic perspective view showing an ordinary TEM-mode half-wave ($\lambda/2$) dielectric resonator.

FIG. 3 is a schematic perspective view showing an ordinary TEM-mode half-wave (λ/2) dielectric resonator.

As shown in FIG. 3, the ordinary half-wave (λ/2) dielectric resonator is constituted of a dielectric block 20, a metal plate 21 formed on the upper surface of the dielectric block 20, and a metal plate 22 formed on the lower surface of the dielectric block 20. The metal plate 21 formed on the upper surface of the dielectric block 20 is electrically floated whereas the metal plate 22 formed on the lower surface of the dielectric block 20 is grounded. All of the four side surfaces of the dielectric block 20 are open to the air. In FIG. 3, the length of one side of the upper surface of the dielectric block 20, the length of another side perpendicular to the one side of upper surface of the dielectric block 20, and the thickness of the dielectric block 20 are indicated by 21, w and h.

For propagation of the dominant TEM-mode along the z direction of this half-wave (λ/2) dielectric resonator, if electric field is negative maximum in the z=0 plane, then it should be positive maximum in the z =21 plane as indicated by the arrow 23 in this Figure. Obviously there should be minimum (zero) electric field in the z=1 plane, which is the symmetry plane 24 of the resonator.

Cutting such a half-wave (λ/2) dielectric resonator along the symmetry plane 24, two quarter-wave (λ/4) dielectric resonators can be obtained. In this quarter-wave (λ/4) dielectric resonator, the z=1 plane acts as a perfect electric conductor (PEC).

Figure 4:
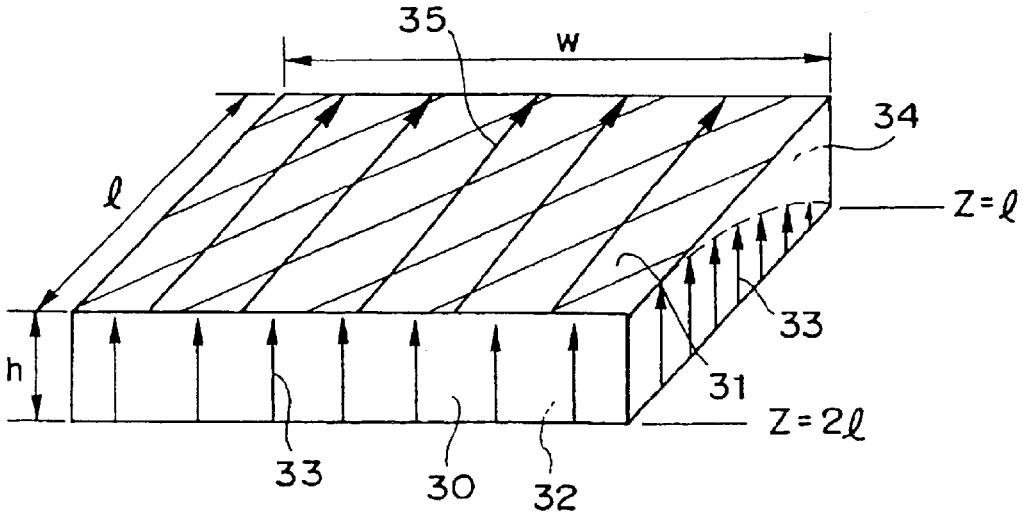
FIG. 4 is a schematic perspective view showing an ordinary quarter-wave ($\lambda/4$) dielectric resonator.

FIG. 4 is a schematic perspective view showing the quarter-wave (λ/4) dielectric resonator obtained by above described method.

As shown in FIG. 4, the quarter-wave (λ/4) dielectric resonator is constituted of a dielectric block 30, a metal plate 31 formed on the upper surface of the dielectric block 30, a metal plate 32 formed on the lower surface of the dielectric block 30, and a metal plate 34 formed on one of the side surfaces of the dielectric block 30. The remaining three side surfaces of the dielectric block 30 are open to the air. The metal plate 32 formed on the lower surface of the dielectric block 30 is grounded. The metal plate 34 formed on one of the side surfaces of the dielectric block 30 corresponds to the perfect electric conductor (PEC) of the half-wave (λ/2) dielectric resonator to short-circuit the metal plate 31 and the metal plate 32. In FIG. 4, arrows 33 indicate electric field, and arrows 35 indicate current flow.

Ideally, the quarter-wave (λ/4) dielectric resonator shown in FIG. 4 and the half-wave (λ/2) dielectric resonator shown in FIG. 3 should have the same resonant frequency. If a material having a relatively high dielectric constant is used for the dielectric block 30, electromagnetic field confinement inside the resonator is adequately strong. Moreover, the distribution of the electromagnetic field of the quarter-wave (λ/4) dielectric resonator becomes substantially the same as that of the half-wave (λ/2) dielectric resonator. As shown in FIGS. 3 and 4, the volume of the quarter-wave (λ/4) dielectric resonator is half the volume of the half-wave (λ/2) dielectric resonator. As a result, the total energy of the quarter-wave (λ/4) dielectric resonator is also half the total energy of the half-wave (λ/2) dielectric resonator. However, the unloaded quality factor ($Q_0$) of the quarter-wave (λ/4) dielectric resonator remain almost the same that of the half-wave (λ/2) dielectric resonator because the energy loss of the quarter-wave (λ/4) dielectric resonator decreases to around 50% that of the half-wave (λ/2) dielectric resonator. The quarter-wave (λ/4) dielectric resonator therefore enables miniaturization without substantially changing the resonant frequency and the unloaded quality factor ($Q_0$).

Figure 5:
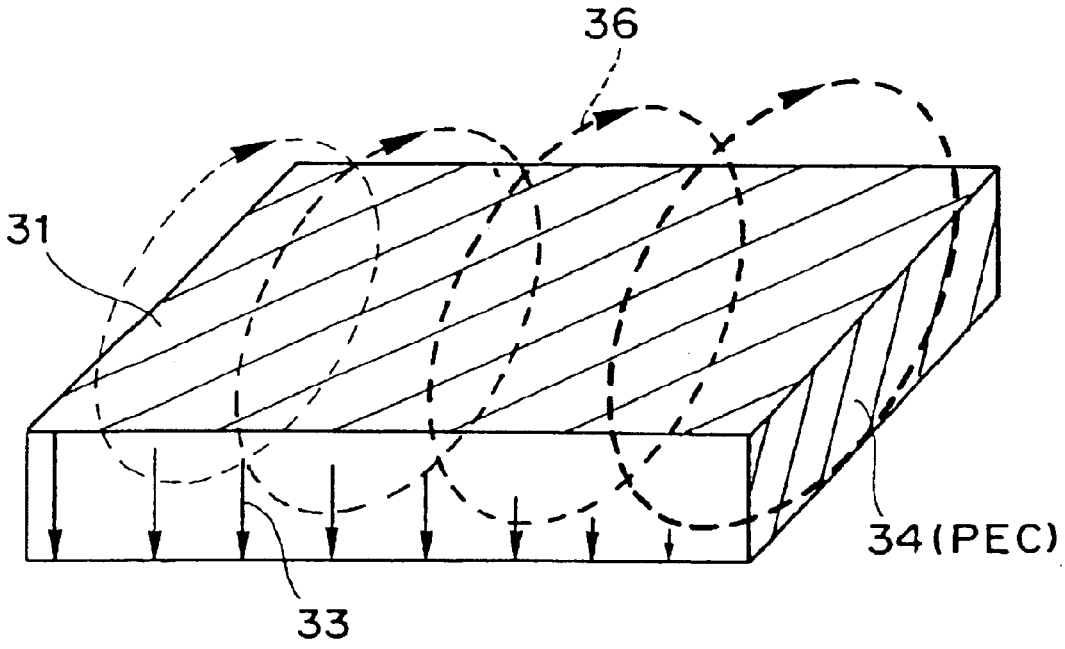
FIG. 5 is a schematic diagram for explaining an electric field and a magnetic field generated by a quarter-wave ($\lambda/4$) dielectric resonator.

FIG. 5 is a schematic diagram for explaining the electric field and the magnetic field generated by the quarter-wave (λ/4) dielectric resonator.

As shown in FIG. 5, the magnetic field 36 of the quarter-wave (λ/4) dielectric resonator is maximum throughout the metal plate 34 formed on one of the side surfaces of the dielectric block 30. By linking the metal plate 34, the magnetic field 36 imparts the effect of an additional series inductance to resonator equivalent circuit. Thus, the resonant frequency of the quarter-wave (λ/4) dielectric resonator becomes slightly lower than that of the half-wave (λ/2) dielectric resonator.

In this type of the quarter-wave (λ/4) dielectric resonator, the resonant frequency f can be represented by the following formula:

$$f = \frac{c}{4 \times l\sqrt{\varepsilon_{eff}}} \tag{1}$$

Where c represents the velocity of light in free space, l represents the length of the quarter-wave (λ/4) dielectric resonator, and $\epsilon_{eff}$ represents the effective dielectric constant, which can be represented by:

$$\varepsilon_{eff} = \frac{\varepsilon_r + 1}{2} + \frac{\varepsilon_r - 1}{2}\left(1 + \frac{10h}{w}\right)^{-5} \tag{2}$$

where $\epsilon_r$ represents the relative permittivity of the material of the dielectric block constituting the quarter-wave (λ/4) dielectric resonator, h represents the thickness of the quarter-wave (λ/4) dielectric resonator, and w represents the width of the quarter-wave (λ/4) dielectric resonator.

By referring the formulas (1) and (2), it is apparent that the resonant frequency mainly depends on the length of the dielectric block but has very little dependence upon thickness and width of the resonator. Specifically, the resonant frequency increases with shorter length of the dielectric block. A quarter-wave (λ/4) dielectric resonator having the desired resonant frequency can therefore be obtained by optimizing the length of the dielectric block constituting the quarter-wave (λ/4) dielectric resonator.

On the other hand, in this type of quarter-wave (λ/4) dielectric resonator, the unloaded quality factor ($Q_0$) depends on the thickness and the width of the dielectric block. Specifically, the unloaded quality factor ($Q_0$) of the quarter-wave (λ/4) dielectric resonator increases in proportion to the thickness of the dielectric block in a first thickness region of the dielectric block smaller than a predetermined thickness and decreases in proportion to the thickness of the dielectric block in a second thickness region of the dielectric block greater than the predetermined thickness. Further, the unloaded quality factor ($Q_0$) of the quarter-wave (λ/4) dielectric resonator increases in proportion to the width of the dielectric block in a first width region of the dielectric block smaller than a predetermined width and becomes substantially constant in a second width region of the dielectric block greater than the predetermined width. A quarter-wave (λ/4) dielectric resonator having the desired unloaded quality factor ($Q_0$) can therefore be obtained by optimizing the thickness and the width of the dielectric block constituting the quarter-wave (λ/4) dielectric resonator.

The bandpass filter 1 of this embodiment is constituted of two quarter-wave (λ/4) dielectric resonators, whose operating principle was explained in the foregoing, and an evanescent waveguide 11 which acts as an H-mode waveguide disposed therebetween.

In order to widen the bandwidth (width of passing band) of the bandpass filter composed of two quarter-wave (λ/4) dielectric resonators, it is effective to enhance the external coupling (exciting capacitance). In the bandpass filter 1 of this embodiment shown in FIGS. 1 and 2, for example, when the exciting electrodes 8 and 9 are disposed on the bottom surface of the dielectric block 2, the external coupling C can be represented by the following formula:

$$C = \frac{\varepsilon_o \varepsilon_\gamma A}{h} \tag{3}$$

where $\epsilon_0$ represents the relative permittivity of air, A represents the area of the exciting electrode, and h represents the thickness of the quarter-wave (λ/4) dielectric resonator.

In the case where the material of the dielectric block has been decided, it is apparent from formula (3) that the area A of the exciting electrode should be made wide and/or the thickness h of the quarter-wave (λ/4) dielectric resonator should be made thin in order to enhance the external coupling C.

However, if the area A of the exciting electrode is made wide, the overall size of the quarter-wave (λ/4) dielectric resonator becomes large. Further, it is difficult to set the area A of the exciting electrode arbitrarily because the resonant frequency strongly depends on the length of the dielectric block. Therefore, in order to enhance the external coupling C, it is preferably that the thickness h of the quarter-wave (λ/4) dielectric resonator be made thin. If the thickness h of the quarter-wave (λ/4) dielectric resonator is made thin, not only does the overall size of the quarter-wave (λ/4) dielectric resonator become small but the radiation loss can also be reduced because the area of the open ends is reduced.

In view of foregoing, in the bandpass filter 1 of this embodiment, the exciting electrodes 8 and 9 are disposed on the bottom surface of a dielectric block 2 whose thickness is very thin (0.6 mm).

Figure 6:
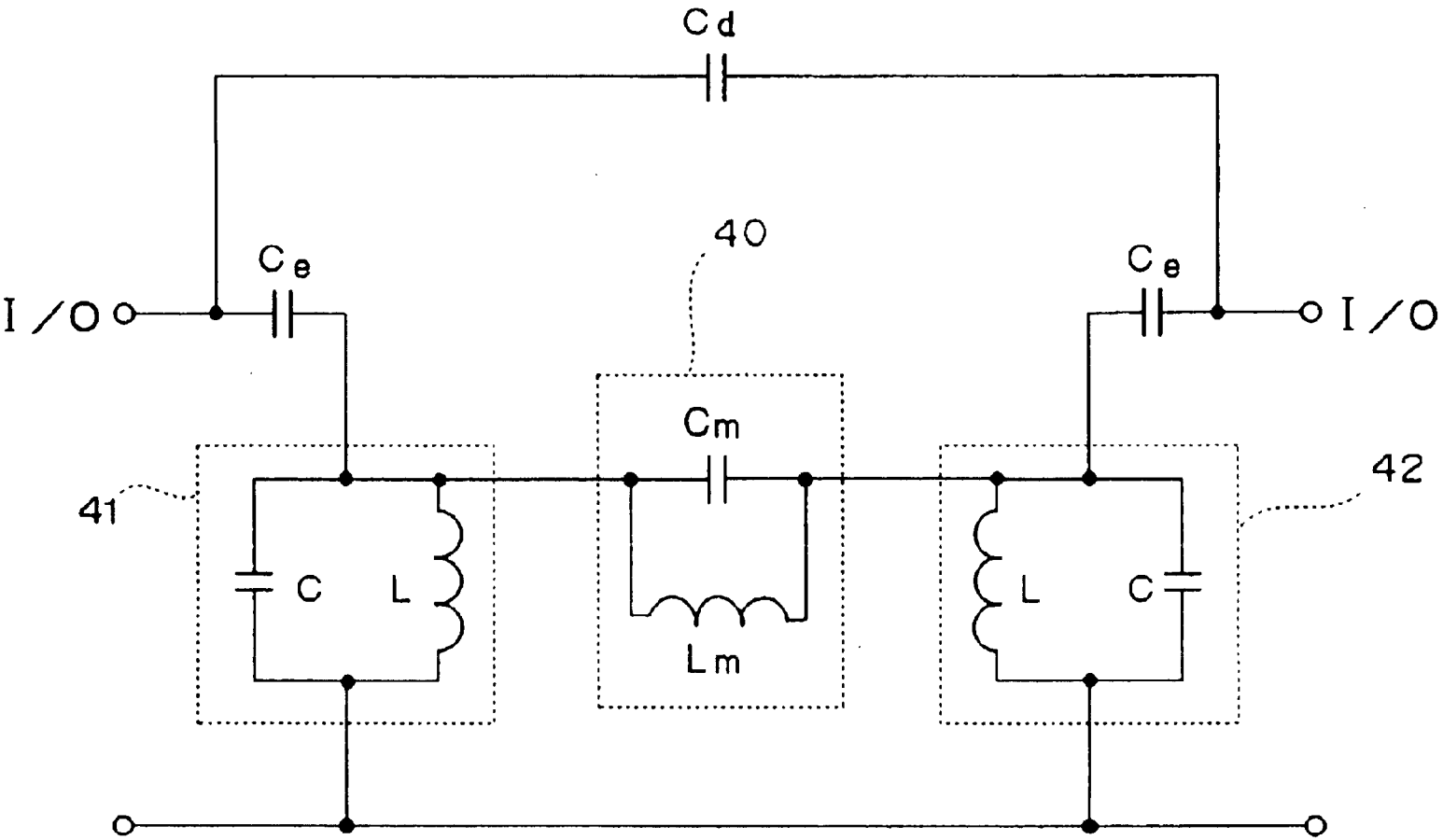
FIG. 6 is an equivalent circuit diagram of the bandpass filter 1 shown in FIGS. 1 and 2.

FIG. 6 is an equivalent circuit diagram of the bandpass filter 1 shown in FIGS. 1 and 2.

In this Figure, the evanescent waveguide 11 is represented by the L-C parallel circuit 40. The first resonator 12 and the second resonator 13 are represented by two L-C parallel circuits 41 and 42, respectively. The exciting electrodes 8 and 9 are represented by two capacitances Ce. Further, the direct coupling capacitance Cd appears between the I/O ports.

The coupling coefficient between the first and second resonators 12 and 13 by the evanescent waveguide 11 can be adjusted by changing the size of the metal plate 7 formed on the bottom surface of the dielectric block 2. In the bandpass filter 1 of this embodiment, for example, when the width of the metal plate 7 is set to 2.2 mm by setting the width of the clearance portion 10 to 1.05 mm, the coupling constant between the first and second resonators 12 and 13 becomes approximately 0.08 and the effective coupling therebetween becomes inductive. As regards the external quality factor (Qe), this can be adjusted by changing the size of the exciting electrodes 8 and 9 formed on the bottom surface of the dielectric block 2. In the bandpass filter 1 of this embodiment, for example, when the size of the exciting electrodes 8 and 9 is set to 0.6 mm×

0.5 mm, the external quality factor (Qe) becomes approximately 12.5.

Figure 7:
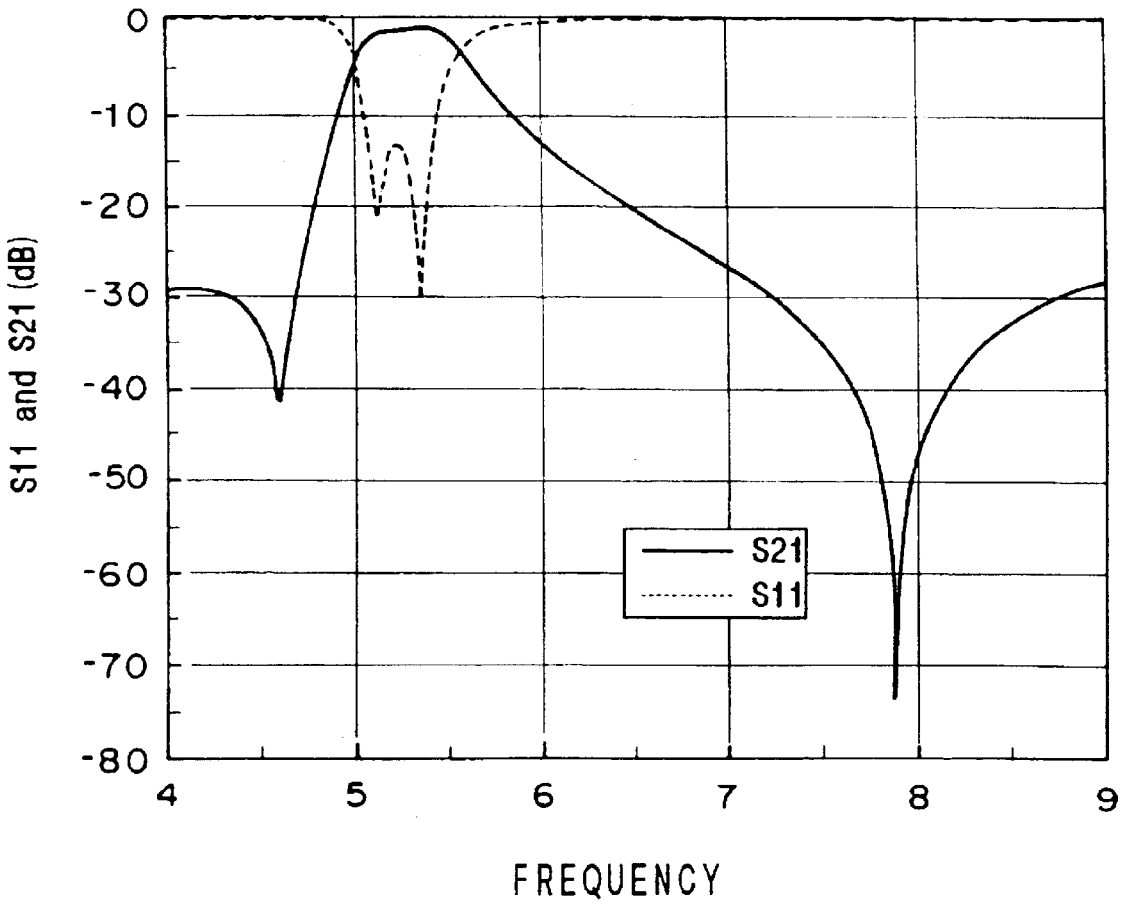
FIG. 7 is graph showing the frequency characteristic curve of the bandpass filter 1 shown in FIGS. 1 and 2.

FIG. 7 is a graph showing the frequency characteristic curve of the bandpass filter 1.

In FIG. 7, S11 represents a reflection coefficient, and S21 represents a transmission coefficient. As shown in FIG. 7, the resonant frequency of the bandpass filter 1 is approximately 5.2 GHz and its 3-dB bandwidth is approximately 580 MHz. That is, according to the bandpass filter 1 of this embodiment, very wide bandwidth can be obtained. Further, attenuation poles appear at approximately 4.6 GHz and approximately 7.9 GHz so that both the higher and lower edges of the passing band of the frequency characteristics are sharpened. The reason why such attenuation poles appear is that the direct coupling capacitance Cd exists between the exciting electrodes 8 and 9.

Because, as described above, the bandpass filter 1 according to this embodiment is constituted of the rectangular prismatic dielectric block 2 having no holes or surface irregularities and the metal plates 3–7 and the exciting electrodes 8 and 9 formed on the surfaces thereof, the mechanical strength is extremely high compared with conventional filters. Thus, even if the overall size of the bandpass filter 1 is reduced, sufficient mechanical strength can be ensured.

Moreover, because the bandpass filter 1 according to this embodiment can be fabricated merely by forming the various metal plates on the dielectric block 2, i.e., because forming holes or irregularities is not necessary as in conventional filters, the fabrication cost can be substantially reduced. Particularly, in the bandpass filter 1 of this embodiment, because the surfaces on which the metal plates or the exciting electrodes should be formed are only the top surface, bottom surface, and third side surface and it is not necessary to form metal plates or exciting electrodes on the other surfaces (first, second and fourth side surfaces), the bandpass filter 1 can be fabricated by a small number of steps.

Further, because the bandpass filter 1 according to this embodiment has the exciting electrodes 8 and 9 disposed on the bottom surface of the dielectric block 2, a wide band characteristic can be obtained while using a very thin dielectric block 2. In addition, because the thickness of the dielectric block 2 is very thin, the radiation loss is very small so that a high unloaded quality factor ($Q_0$) can be obtained.

Moreover, in the bandpass filter 1 of this embodiment, because the direct coupling capacitance Cd exists between the exciting electrodes 8 and 9, the attenuation poles appear at both the higher and lower edges of the passing band of the frequency characteristics so that sharpened attenuation characteristics can be obtained.

Figure 8:
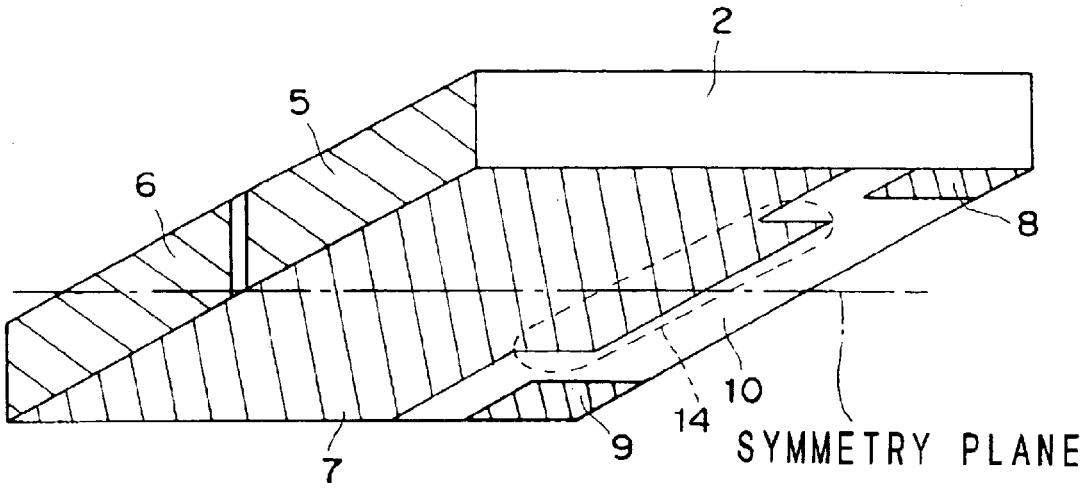
FIG. 8 is a schematic perspective view showing an example in which a projecting portion 14 is added to a metal plate 7 of the bandpass filter 1 shown in FIGS. 1 and 2.
Figure 9:
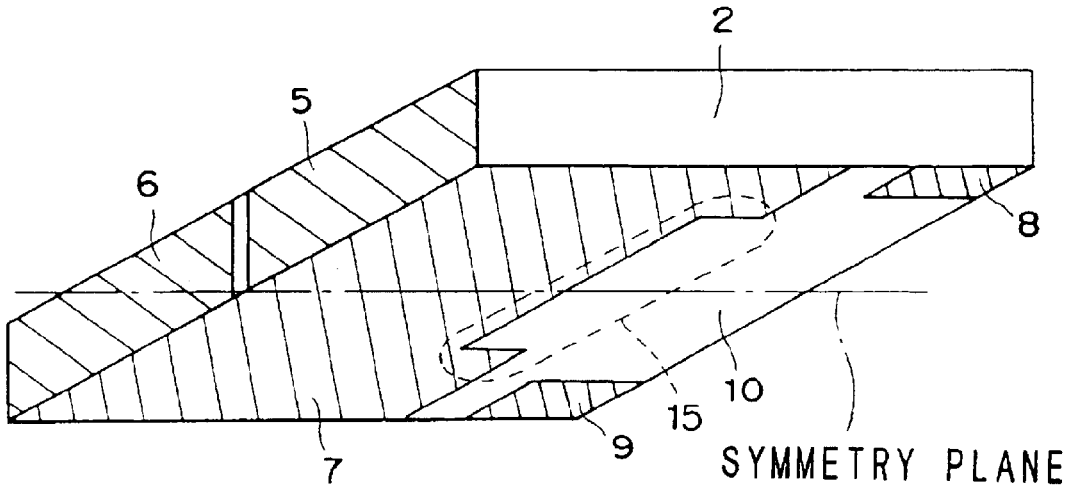
FIG. 9 is a schematic perspective view showing an example in which a removed portion 15 is formed in a metal plate 7 of the bandpass filter 1 shown in FIGS. 1 and 2.

The coupling coefficient between the first and second resonators 12 and 13 can be adjusted by not only changing the width of the clearance portion 10 but also by adding the projecting portion 14 to the metal plate 7 as shown in FIG. 8 or by forming the removed portion 15 from the metal plate 7 as shown in FIG. 9. In case of using the metal plate 7 having such an irregular shape, the shape of the metal plate 7 should be symmetrical with respect to the symmetry plane because the effect produced by the irregular shape should be equally imparted to the first and second resonators 12 and 13. Thus, when the metal plate 7 having an irregular shape is used, not only is the design flexibility enhanced but it is also possible to reduce the overall size of the bandpass filter.

Another preferred embodiment of the present invention will now be explained.

Figure 10:
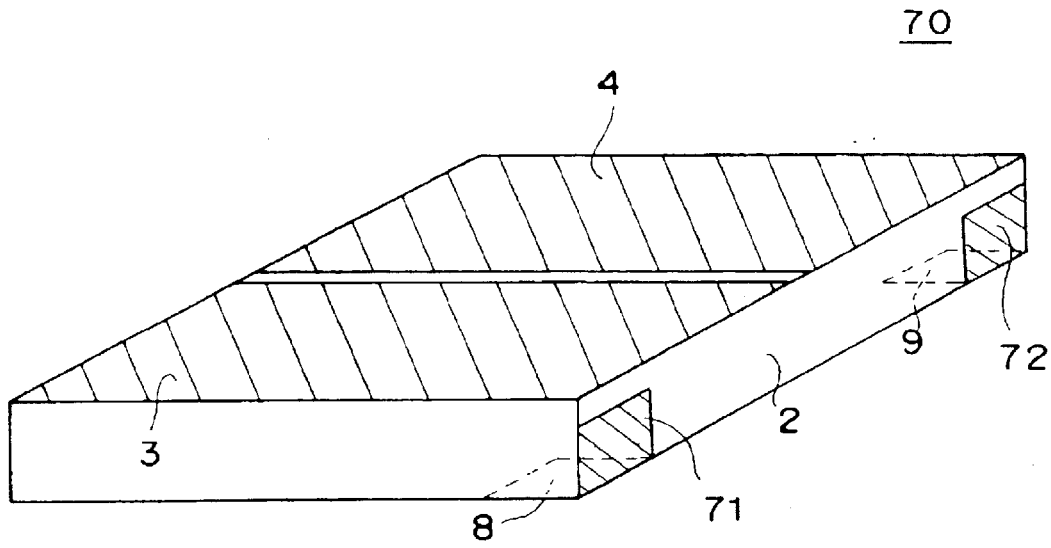
FIG. 10 is a schematic perspective view from the top side showing a bandpass filter 70 that is another preferred embodiment of the present invention.
Figure 11:
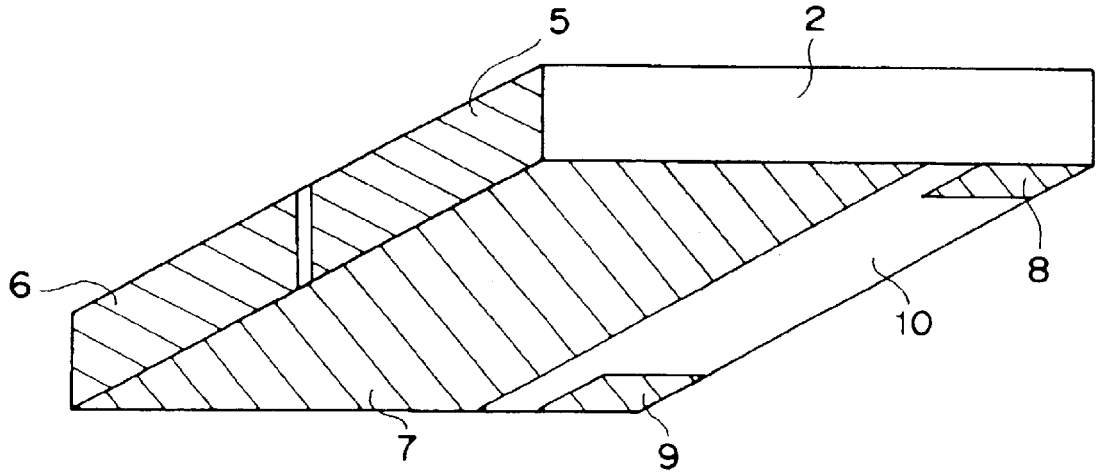
FIG. 11 is a schematic perspective view from the bottom side showing the bandpass filter 70 of FIG. 10.

FIG. 10 is a schematic perspective view from the top side showing a bandpass filter 70 that is another preferred embodiment of the present invention. FIG. 11 is a schematic perspective view from the bottom side showing the bandpass filter 70 of FIG. 10.

As shown in FIGS. 10 and 11, the bandpass filter 70 is a modification of the bandpass filter 1 of the above-described embodiment and has the same configuration as the bandpass filter 1 except that exciting electrodes 71 and 72 are added to the fourth side surface of the dielectric block 2. The exciting electrode 71 is in contact with the exciting electrode 8 formed on the bottom surface of the dielectric block 2 and the exciting electrode 72 is in contact with the exciting electrode 9 formed on the bottom surface of the dielectric block 2. That is, the exciting electrode 71 can be considered to be an extended portion of the exciting electrode 8 and the exciting electrode 72 can be considered to be an extended portion of the exciting electrode 9.

In the bandpass filter 70 of this embodiment, because the exciting electrodes 71 and 72 are added, larger external coupling can be obtained than in bandpass filter 1. Thus, according to the bandpass filter 70 of this embodiment, still wider bandwidth (width of passing band) can be obtained. Further, because the exciting electrodes 71 and 72 are provided on the portions where the electric field is maximum, the radiation loss can be reduced.

Also in the bandpass filter 70 of this embodiment, the coupling coefficient between first and second resonators 12 and 13 can be adjusted not only by changing the width of the clearance portion 10 but also by changing the shape of the metal plate 7 to an irregular shape as shown in FIGS. 8 and 9.

Still another preferred embodiment of the present invention will now be explained.

Figure 12:
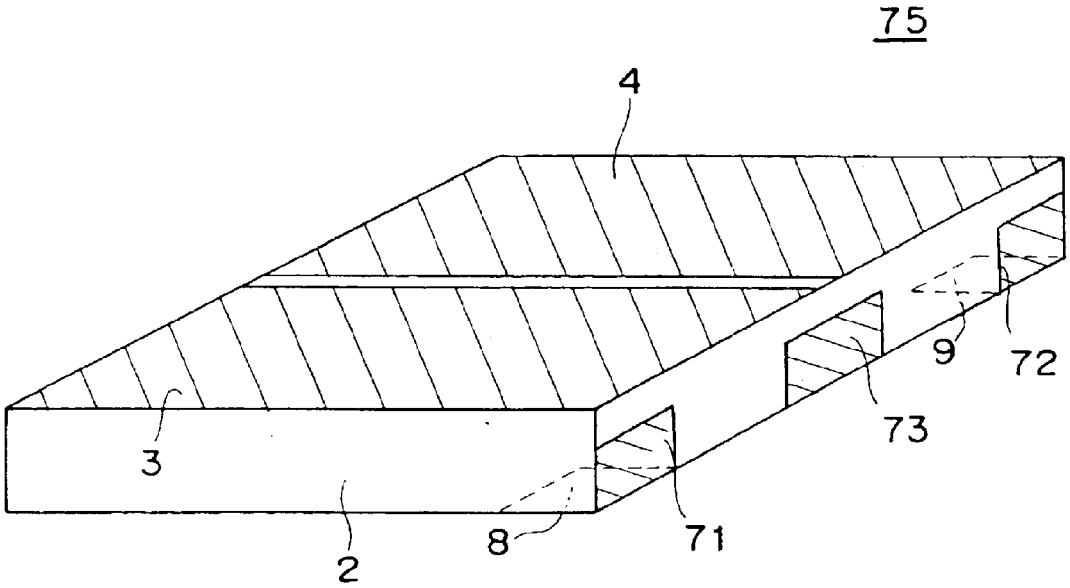
FIG. 12 is a schematic perspective view from the top side showing a bandpass filter 75 that is still another preferred embodiment of the present invention.
Figure 13:
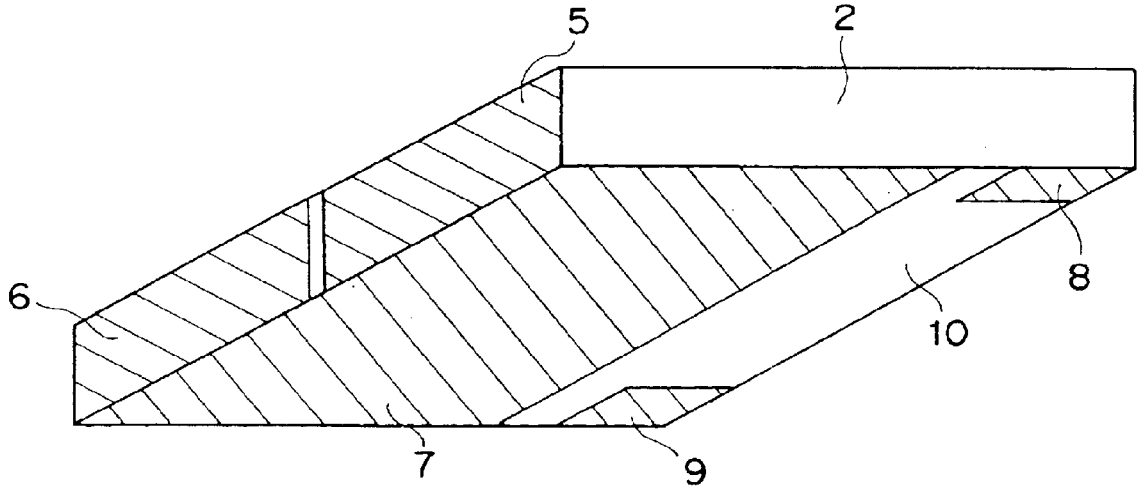
FIG. 13 is a schematic perspective view from the bottom side showing the bandpass filter 75 of FIG. 12.

FIG. 12 is a schematic perspective view from the top side showing a bandpass filter 75 that is still another preferred embodiment of the present invention. FIG. 13 is a schematic perspective view from the bottom side showing the bandpass filter 75 of FIG. 12.

As shown in FIGS. 12 and 13, the bandpass filter 75 is a modification of the bandpass filter 70 of the above-described embodiment and has the same configuration as the bandpass filter 70 except that a non-grounded capacitive stub 73 is added to the fourth side surface of the dielectric block 2. The non-grounded capacitive stub 73 is not in contact with any metal plate or exciting electrode. The resonant frequency of the bandpass filter 75 of this embodiment is lowered compared with the original resonant frequency by adding the non-grounded capacitive stub 73. This means that substantially the same characteristics as the bandpass filter 70 can be obtained at a smaller size.

Thus, the bandpass filter 75 of this embodiment exhibits an effect of enabling overall size reduction owing to the provision of the non-grounded capacitive stub 73 in addition to the same effects as the bandpass filter 70 of the above-described embodiment.

Further, also in the bandpass filter 75 of this embodiment, the coupling coefficient between first and second resonators 12 and 13 can be adjusted not only by changing the width of the clearance portion 10 but also by changing the shape of the metal plate 7 to an irregular shape as shown in FIGS. 8 and 9.

It is worth noting that although the exciting electrodes 71 and 72 are provided on the fourth side surface of the dielectric block 2, in the bandpass filter 75 of this embodiment the exciting electrodes 71 and 72 can be eliminated while leaving the non-grounded capacitive stub 73.

Still another preferred embodiment of the present invention will now be explained.

Figure 14:
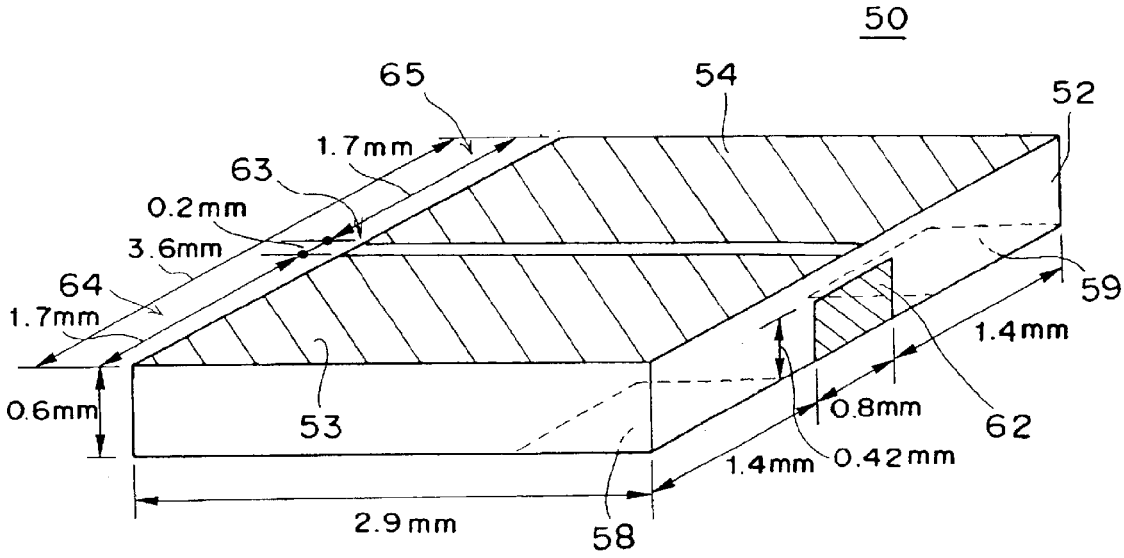
FIG. 14 is a schematic perspective view from the top side showing a bandpass filter 50 that is still another preferred embodiment of the present invention.
Figure 15:
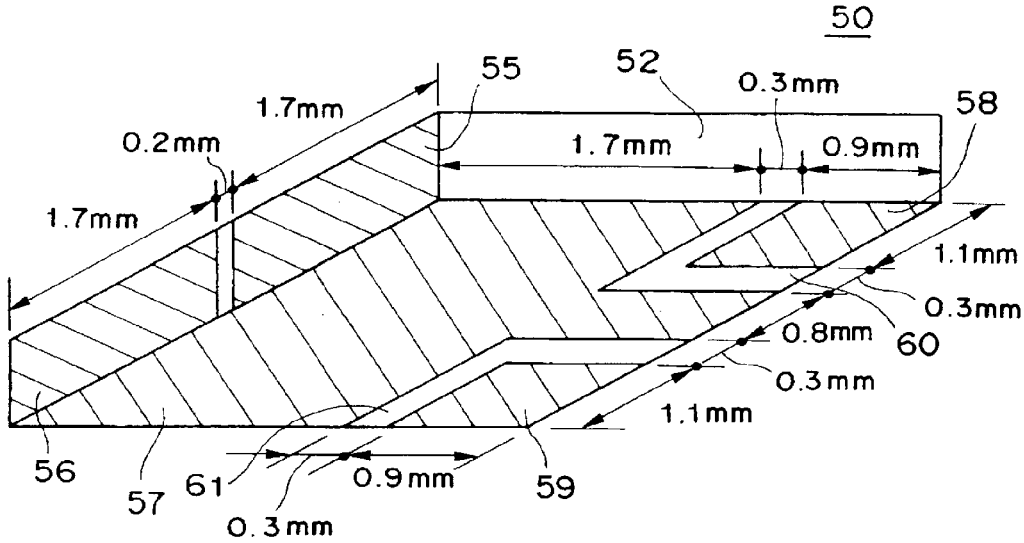
FIG. 15 is a schematic perspective view from the bottom side showing the bandpass filter 50 of FIG. 14.

FIG. 14 is a schematic perspective view from the top side showing a bandpass filter 50 that is still another preferred embodiment of the present invention. FIG. 15 is a schematic perspective view from the bottom side showing the bandpass filter 50 of FIG. 14.

As shown in FIGS. 14 and 15, the bandpass filter 50 is constituted of a dielectric block 52 and various metal plates formed on the surface thereof. The dielectric block 52 is made of dielectric material whose dielectric constant $\epsilon_r$ is 33, for example, and has the shape of a rectangular prism whose length, width, and thickness are 3.6 mm, 2.9 mm, and 0.6 mm. That is, the dielectric block 52 has no holes or surface irregularities. The dielectric block 52 is approximately 10% shortened in length and width relative to the dielectric block 2 used for the bandpass filter 1.

Further, the dielectric block 52 is composed of a first portion lying between a first cross-section and a second cross-section parallel to the first cross-section and second and third portions divided by the first portion. The first portion of the dielectric block 52, whose length, width, and thickness are 0.2 mm, 2.9 mm, and 0.6 mm, is located at the center of the rectangular prismatic dielectric block 52. The second and third portions of the dielectric block 52 are symmetrically located relative to the first portion. Each measures 1.7 mm, 2.9 mm, and 0.6 mm in length, width and thickness.

As shown in FIGS. 14 and 15, metal plates 53 and 54 are formed on the top surface of the dielectric block 52 corresponding to the entire second and third portions, respectively; metal plates 55 and 56 are formed on the third side surface of the dielectric block 52 corresponding to the entire second and third portions, respectively; a metal plate 57 of T-shape is formed on the bottom surface of the dielectric block 52; and exciting electrodes 58 and 59, whose length and width are 1.1 mm and 0.9 mm, is formed on the bottom surface of the dielectric block 52. The metal plate 57 and the exciting electrode 58 are prevented from being in contact with one another by a clearance portion 60, whose width is 0.3 mm. The metal plate 57 and the exciting electrode 59 are prevented from being in contact with one another by a clearance portion 61, whose width is 0.3 mm. As shown in FIG. 15, the metal plate 57 is in contact with all of the side of the bottom surface close to the third side surface, and a part of the each side of the bottom surface close to the first, second and fourth side surfaces. The length of the edge of the metal plate 57 in contact with the each side of the bottom surface close to the first and second side surfaces measures 1.7 mm. The length of the edge of the metal plate 57 in contact with the side of the bottom surface close to the fourth side surface measures 0.8 mm. The exciting electrode 58 is located at the corner of the bottom surface of the dielectric block 52 close to the first and fourth side surfaces. The exciting electrode 59 is located at the corner of the bottom surface of the dielectric block 52 close to the second and fourth side surfaces.

Further, a capacitive stub 62 is formed on the center of the fourth side surface of the dielectric block 52, which measures 0.8 mm and 0.42 mm in height and width. The capacitive stub 62 is in contact with the metal plate 57 formed on the bottom surface. That is, the capacitive stub 62 can be considered to be an extended portion of the metal plate 57 formed on the bottom surface. The direction defining the "width" of the capacitive stub 62 is coincident with the direction defining the "length" of the dielectric block 52.

The metal plate 55 is in contact with the metal plates 54 and 57. The metal plate 56 is in contact with the metal plates 53 and 57. That is, these metal plates 53–57 and the capacitive stub 62 are short-circuited to one another and grounded. One of the exciting electrodes 58 and 59 is used as an input electrode, and the other is used as an output electrode.

No metal plate or electrode is formed on the remaining surfaces of the dielectric block 52, which therefore constitute open ends. Since the bandpass filter 50 does not require any metal plate or electrode to be formed on the first and second side surfaces of the dielectric block 52, metallization for only the top, bottom and third and fourth side surfaces of the dielectric block 52 is required during fabrication of the bandpass filter 50.

According to the above described structure, the first portion of the dielectric block 52 and the metal plate formed thereon act as an evanescent waveguide 63, the second portion of the dielectric block 52 and the metal plate formed thereon act as a first resonator 64, and the third portion of the dielectric block 52 and the metal plate formed thereon act as a second resonator 65. The evanescent waveguide 63 is an E-mode waveguide, and each of the first and second resonators 64 and 65 is a quarter-wave ($\lambda/4$) dielectric resonator.

Figure 16:
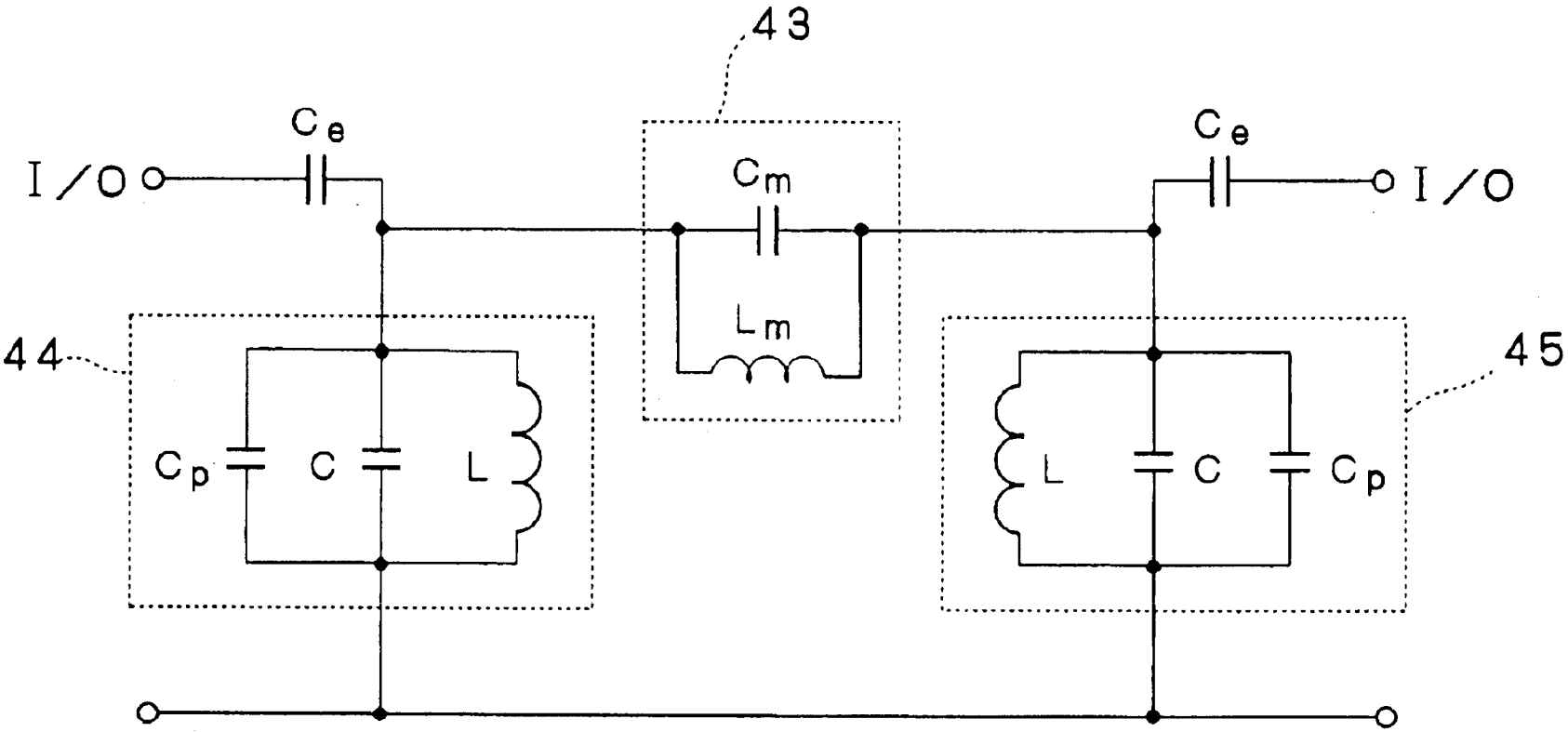
FIG. 16 is an equivalent circuit diagram of the bandpass filter 50 shown in FIGS. 14 and 15.

FIG. 16 is an equivalent circuit diagram of the bandpass filter 50.

In this Figure, the evanescent waveguide 63 is represented by the L-C parallel circuit 43. The first resonator 64 and the second resonator 65 are represented by two L-C parallel circuits 44 and 45, respectively. Two capacitancess Cp are produced by the capacitive stub 62. In the bandpass filter 50 of this embodiment, very little direct coupling capacitance exists between the I/O ports because the metal plate 57 is interposed between the exciting electrodes 58 and 59.

Figure 17:
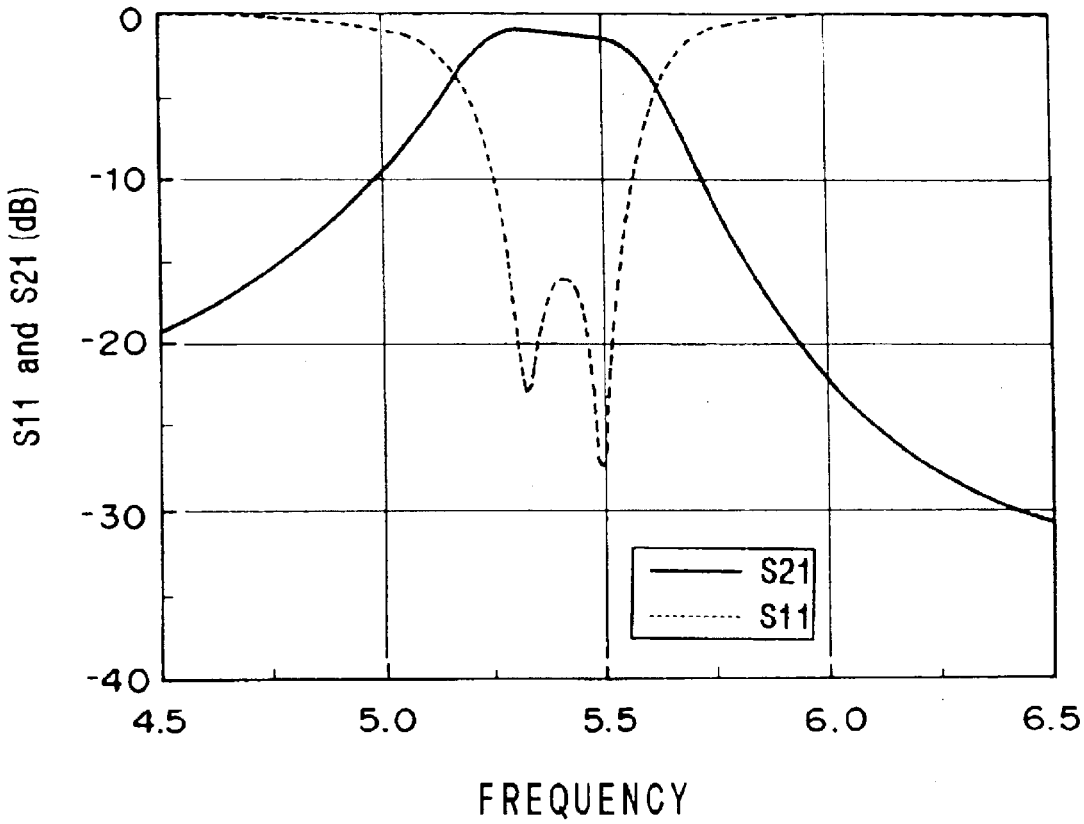
FIG. 17 is graph showing the frequency characteristic curve of the bandpass filter 50 shown in FIGS. 14 and 15.

FIG. 17 is graph showing the frequency characteristic curve of the bandpass filter 50.

In FIG. 17, S11 represents a reflection coefficient, and S21 represents a transmission coefficient. As shown in FIG. 17, the resonant frequency of the bandpass filter 50 is approximately 5.3 GHz and its 3-dB bandwidth is approximately 450 MHz. That is, the bandpass filter 50 exhibits almost the same characteristics as the bandpass filter 1.

As described above, according to the bandpass filter 50, substantially the same characteristics as the bandpass filter 1 can be obtained even though its length and width are approximately 10% shortened relative to the bandpass filter 1. This is an effect caused mainly by adding the capacitive stub 62. When the capacitive stub 62 is added, effective coupling between the first and second resonators 64 and 65 becomes inductive. Further, because the capacitive stub 62 is grounded by contact with the metal plate 57, unlike the non-grounded capacitive stub 73 used in the bandpass filter 75, the effect of reducing the overall size of the bandpass filter is pronounced compared with the non-grounded capacitive stub 73.

Thus, in the bandpass filter 50 of this embodiment, a further reduction of the overall size can be realized in addition to the same effects as the bandpass filter 1 of the above-described embodiment.

Still another preferred embodiment of the present invention will now be explained.

Figure 18:
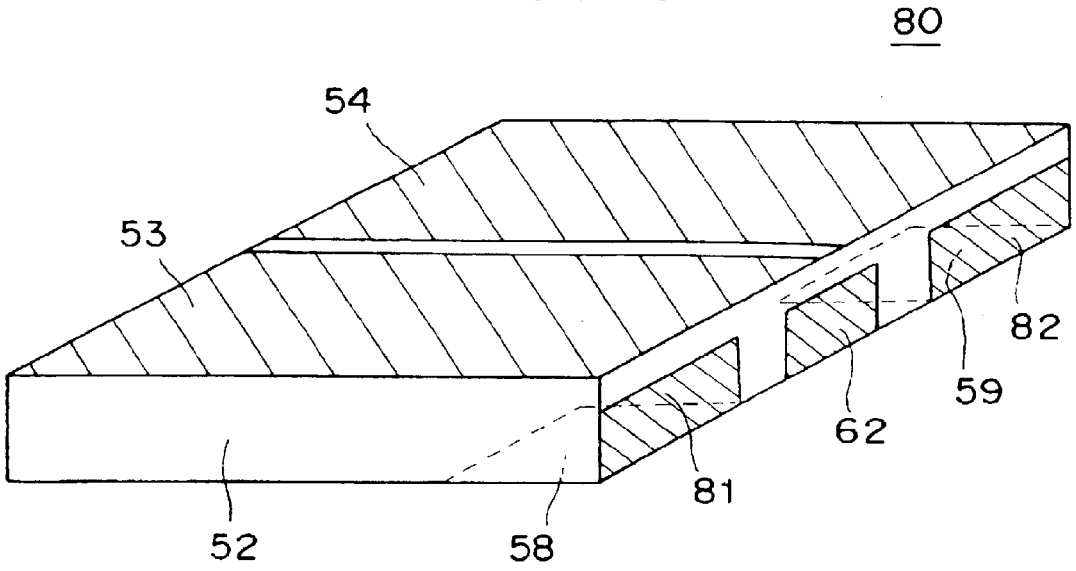
FIG. 18 is a schematic perspective view from the top side showing a bandpass filter 80 that is still another preferred embodiment of the present invention.
Figure 19:
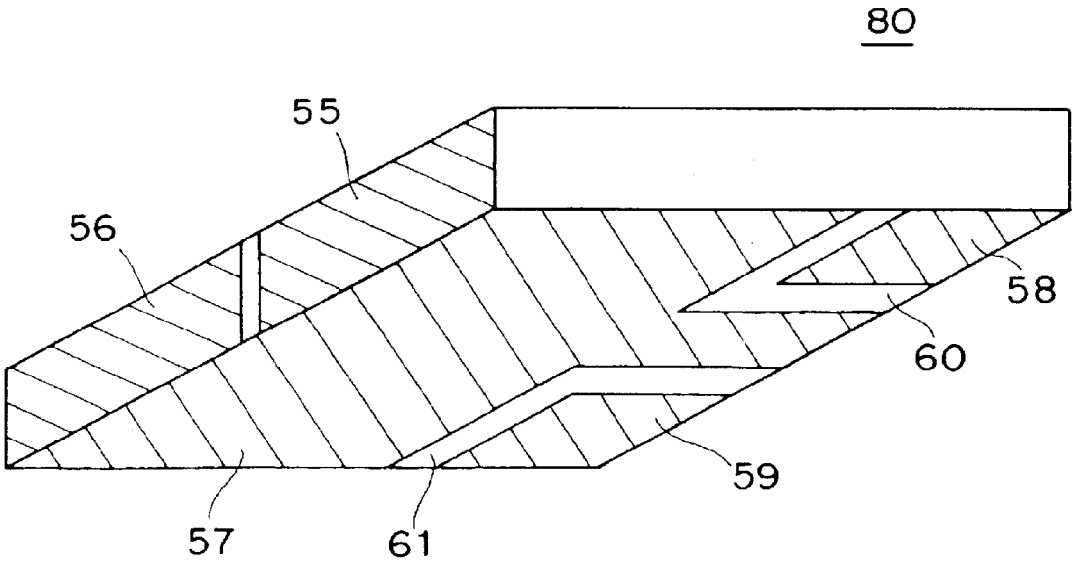
FIG. 19 is a schematic perspective view from the bottom side showing the bandpass filter 80 of FIG. 18.

FIG. 18 is a schematic perspective view from the top side showing a bandpass filter 80 that is still another preferred embodiment of the present invention. FIG. 19 is a schematic perspective view from the bottom side showing the bandpass filter 80 of FIG. 18.

As shown in FIGS. 18 and 19, the bandpass filter 80 is a modification of the bandpass filter 50 of the above-described embodiment and has the same configuration as the bandpass filter 50 except that exciting electrodes 81 and 82 are added to the fourth side surface of the dielectric block 52. The exciting electrode 81 is in contact with the exciting electrode 58 formed on the bottom surface of the dielectric block 52 and the exciting electrode 82 is in contact with the exciting electrode 59 formed on the bottom surface of the dielectric block 52. That is, the exciting electrode 81 can be considered to be an extended portion of the exciting electrode 58 and the exciting electrode 82 can be considered to be an extended portion of the exciting electrode 59.

In the bandpass filter 80 of this embodiment, because the exciting electrodes 81 and 82 are added, larger external coupling can be obtained than in bandpass filter 50. Thus, according to the bandpass filter 80 of this embodiment, wider bandwidth (width of passing band) can be obtained and the radiation loss can be reduced.

Still another preferred embodiment of the present invention will now be explained.

Figure 20:
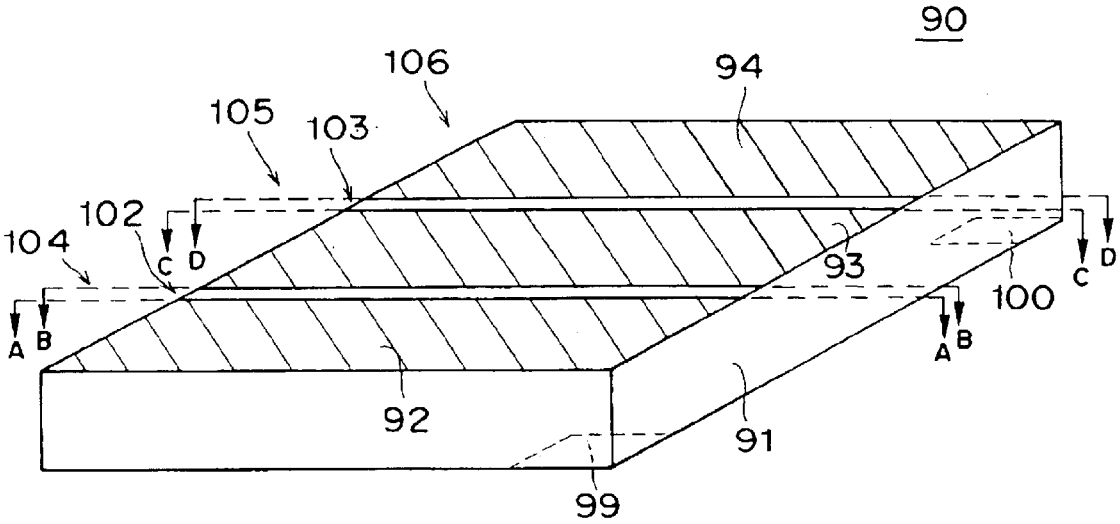
FIG. 20 is a schematic perspective view from the top side showing a bandpass filter 90 that is still another preferred embodiment of the present invention.
Figure 21:
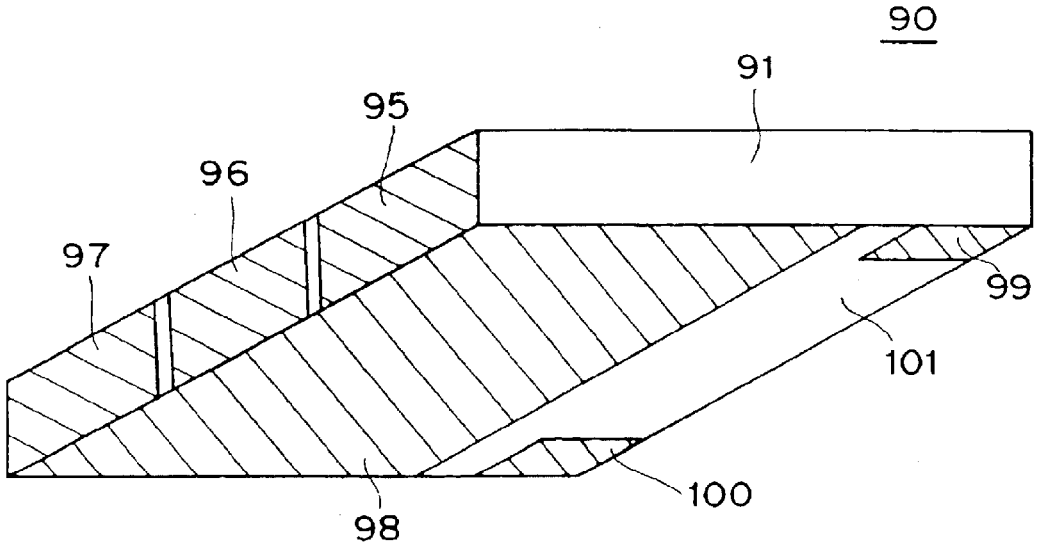
FIG. 21 is a schematic perspective view from the bottom side showing the bandpass filter 90 of FIG. 20.

FIG. 20 is a schematic perspective view from the top side showing a bandpass filter 90 that is still another preferred embodiment of the present invention. FIG. 21 is a schematic perspective view from the bottom side showing the bandpass filter 90 of FIG. 20.

As shown in FIGS. 20 and 21, the bandpass filter 90 is constituted of a dielectric block 91 and various metal plates formed on the surface thereof. The dielectric block 91 is made of dielectric material whose dielectric constant $\epsilon_r$ is 33, for example, and has the shape of a rectangular prism. That is, the dielectric block 91 has no holes or surface irregularities.

The dielectric block 91 is composed of a first portion lying between an A—A cross-section (first cross-section) and a B—B cross-section (second cross-section) parallel to the first cross-section, a second portion lying between a C—C cross-section (third cross-section) and a D—D cross-section (fourth cross-section) parallel to the third cross-section, a third portion lying between the first side surface and the A—A cross-section (first cross-section), a fourth portion lying between the B—B cross-section (second cross-section) and the C—C cross-section (third cross-section), and a fifth portion lying between the second side surface and the D—D cross-section (fourth cross-section). Details will be explained later but the first and second portions constitute a part of first and second evanescent waveguides, respectively, and the third to fifth portions constitute a part of first to third resonators, respectively.

The definitions of the top surface, bottom surface, and first to fourth side surfaces of the dielectric block 91 are the same as those of the dielectric block 2.

As shown in FIG. 20, metal plates 92–94 are formed on the top surface of the dielectric block 91 corresponding to the third, fourth and fifth portion, respectively. As shown in FIG. 21, metal plates 95–97 are formed on the third side surface of the dielectric block 91 corresponding to the third, fourth and fifth portion, respectively. Further, a metal plate 98 and exciting electrodes 99 and 100 are formed on the bottom surface of the dielectric block 91. The metal plate 98 and the exciting electrodes 99 and 100 are prevented from being in contact with one another by a clearance portion 101. As shown in FIG. 21, the metal plate 98 has a rectangular shape with one of its long sides coincident with the side of the bottom surface close to the third side surface and each short side is coincident with the side of the bottom surface close to the first and second side surfaces, respectively. The exciting electrode 99 is located at the corner of the bottom surface of the dielectric block 91 close to the first and fourth side surfaces. The exciting electrode 100 is located at the corner of the bottom surface of the dielectric block 91 close to the second and fourth side surfaces.

The metal plate 95 is in contact with the metal plates 92 and 98, the metal plate 96 is in contact with the metal plates 93 and 98, and the metal plate 97 is in contact with the metal plates 94 and 98. That is, these metal plates 92–98 are short-circuited to one another and grounded. One of the exciting electrodes 99 and 100 is used as an input electrode, and the other is used as an output electrode.

No metal plate or electrode is formed on the remaining surfaces of the dielectric block 91, which therefore constitute open ends. Since the bandpass filter 90 does not require any metal plate or electrode to be formed on the first, second and fourth side surfaces of the dielectric block 91, metallization for only the top, bottom and third side surfaces of the dielectric block 91 is required during fabrication of the bandpass filter 90.

According to the above described structure, the first portion of the dielectric block 91 and the metal plate formed thereon act as a first evanescent waveguide 102, the second portion of the dielectric block 91 and the metal plate formed thereon act as a second evanescent waveguide 103, the third portion of the dielectric block 91 and the metal plate formed thereon act as a first resonator 104, the fourth portion of the dielectric block 91 and the metal plate formed thereon act as a second resonator 105, and the fifth portion of the dielectric block 91 and the metal plate formed thereon act as a third resonator 106. Each of the first and second evanescent waveguides 102 and 103 is an E-mode waveguide, and each of the first to third resonators 104 to 106 is a quarter-wave ($\lambda/4$) dielectric resonator. That is, the bandpass filter 90 is a kind of three-stage bandpass filter employing three resonators.

In the bandpass filter 90, frequency characteristics having sharp edges compared with the above-described bandpass filter 1 can be obtained by setting the coupling constant k1 between the first resonator 104 and the second resonator 105 and the coupling constant k2 between the second resonator 105 and the third resonator 106 to substantially the same value.

Because, as described above, the bandpass filter 90 according to this embodiment is constituted of the rectangular prismatic dielectric block 91 having no holes or surface irregularities and the metal plates and electrodes formed on the surfaces thereof, even if the overall size of the bandpass filter 90 is reduced, sufficient mechanical strength can be ensured. Further, because the exciting electrodes 99 and 100 are disposed on the bottom surface of the dielectric block 91, a wide band characteristic can be obtained while using a very thin dielectric block 91.

Still another preferred embodiment of the present invention will now be explained.

Figure 22:
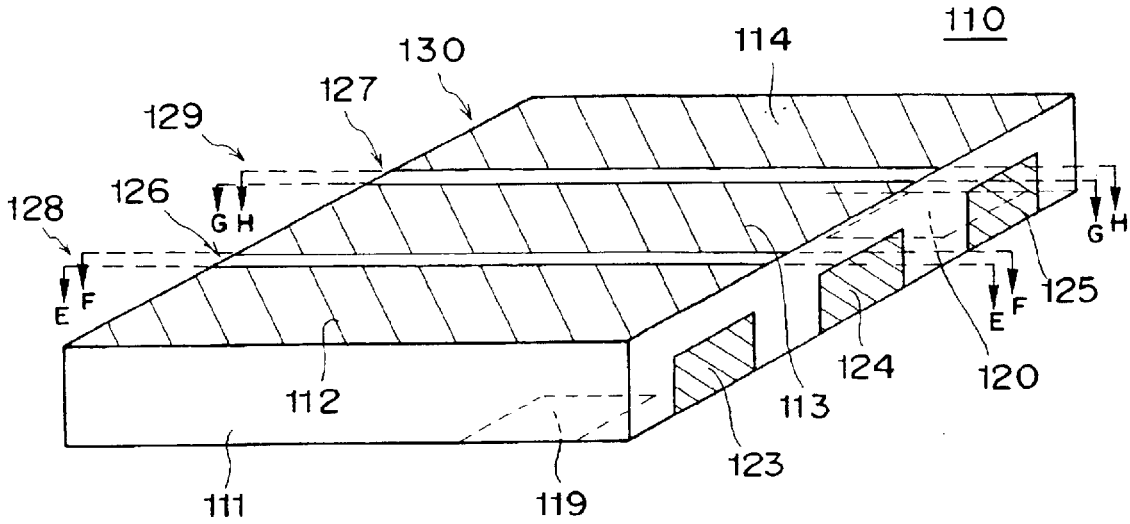
FIG. 22 is a schematic perspective view from the top side showing a bandpass filter 110 that is still another preferred embodiment of the present invention.
Figure 23:
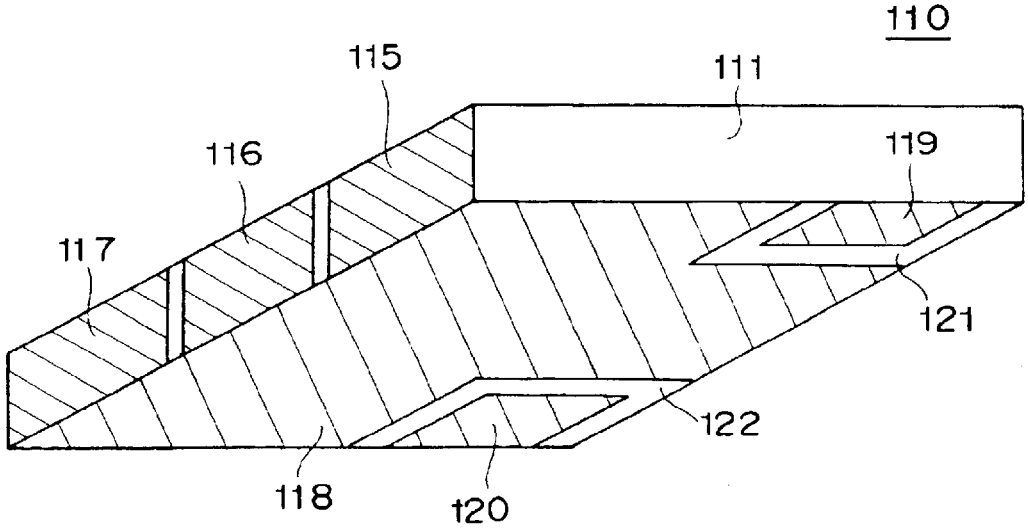
FIG. 23 is a schematic perspective view from the bottom side showing the bandpass filter 110 of FIG. 22.

FIG. 22 is a schematic perspective view from the top side showing a bandpass filter 110 that is still another preferred embodiment of the present invention. FIG. 23 is a schematic perspective view from the bottom side showing the bandpass filter 110 of FIG. 22.

As shown in FIGS. 22 and 23, the bandpass filter 110 is constituted of a dielectric block 111 and various metal plates formed on the surface thereof. The dielectric block 111 is made of dielectric material whose dielectric constant $\epsilon_r$ is 33, for example, and has the shape of a rectangular prism. That is, the dielectric block 111 has no holes or surface irregularities.

The dielectric block 111 is composed of a first portion lying between an E—E cross-section (first cross-section) and a F—F cross-section (second cross-section) parallel to the first cross-section, a second portion lying between an G—G cross-section (third cross-section) and an H—H cross-section (fourth cross-section) parallel to the third cross-section, a third portion lying between the first side surface and the E—E cross-section (first cross-section), a fourth portion lying between the F—F cross-section (second cross-section) and a G—G cross-section (third cross-section), and a fifth portion lying between the second side surface and the H—H cross-section (fourth cross-section). Details will be explained later but the first and second portions constitute a part of first and second evanescent waveguides, respectively, and the third to fifth portions constitute a part of first to third resonators, respectively.

The definitions of the top surface, bottom surface, and first to fourth side surfaces of the dielectric block 111 are the same as those of the dielectric block 2.

As shown in FIG. 22, metal plates 112–114 are formed on the top surface of the dielectric block 111 corresponding to the third, fourth and fifth portion, respectively. As shown in FIG. 23, metal plates 115–117 are formed on the third side surface of the dielectric block 111 corresponding to the third, fourth and fifth portion, respectively. Further, a metal plate 118 and exciting electrodes 119 and 120 are formed on the bottom surface of the dielectric block 111. The metal plate 118 and the exciting electrode 119 are prevented from being in contact with each other by a clearance portion 121, and the metal plate 118 and the exciting electrode 120 are prevented from being in contact with each other by a clearance portion 122. As shown in FIG. 23, the metal plate 118 is T-shaped and in contact with all of the side of the bottom surface close to the third side surface, a part of the each sides of the bottom surface close to the first, second and fourth side surfaces. The exciting electrode 119 is located at the corner of the bottom surface of the dielectric block 111 close to the first and fourth side surfaces. The exciting electrode 120 is located at the corner of the bottom surface of the dielectric block 111 close to the second and fourth side surfaces.

Further, first to third capacitive stubs 123–125 are formed on the fourth side surface of the dielectric block 111 corresponding to the third, fourth and fifth portion, respectively. The first to third capacitive stubs 123–125 are in contact with the metal plate 118 formed on the bottom surface.

The metal plate 115 is in contact with the metal plates 112 and 118, the metal plate 116 is in contact with the metal plates 113 and 118, and the metal plate 117 is in contact with the metal plates 114 and 118. That is, the metal plates 112–118 and the first to third capacitive stubs 123–125 are short-circuited to one another and grounded. One of the exciting electrodes 119 and 120 is used as an input electrode, and the other is used as an output electrode.

No metal plate or electrode is formed on the remaining surfaces of the dielectric block 111, which therefore constitute open ends. Since the bandpass filter 110 does not require any metal plate or electrode to be formed on the first and second side surfaces of the dielectric block 111, metallization for only the top, bottom and third and fourth side surfaces of the dielectric block 111 is required during fabrication of the bandpass filter 110.

According to the above described structure, the first portion of the dielectric block 111 and the metal plate formed thereon act as a first evanescent waveguide 126, the second portion of the dielectric block 111 and the metal plate formed thereon act as a second evanescent waveguide 127, the third portion of the dielectric block 111 and the metal plate formed thereon act as a first resonator 128, the fourth portion of the dielectric block 111 and the metal plate formed thereon act as a second resonator 129, and the fifth portion of the dielectric block 111 and the metal plate formed thereon act as a third resonator 130. Each of the first and second evanescent waveguides 126 and 127 is an E-mode waveguide, and each of the first to third resonators 128 to 130 is a quarter-wave ($\lambda/4$) dielectric resonator. That is, the bandpass filter 110 is a kind of three-stage bandpass filter employing three resonators.

In the bandpass filter 110, frequency characteristics having sharp edges compared with the above-described bandpass filter 50 can be obtained by setting the coupling constant k1 between the first resonator 128 and the second resonator 129 and the coupling constant k2 between the second resonator 129 and the third resonator 130 to substantially the same value.

Because, as described above, the bandpass filter 110 according to this embodiment is constituted of the rectangular prismatic dielectric block 111 having no holes or surface irregularities and the metal plates and electrodes formed on the surfaces thereof, even if the overall size of the bandpass filter 110 is reduced, sufficient mechanical strength can be ensured. Further, because the exciting electrodes 119 and 120 are disposed on the bottom surface of the dielectric block 111, a wide band characteristic can be obtained while using a very thin dielectric block 111.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the dielectric block portions for the resonators and the evanescent waveguide are made of dielectric material whose dielectric constant $\epsilon_r$ is 33. However, a material having a different dielectric constant can be used according to purpose.

Further, the dimensions of the resonators and the evanescent waveguide specified in the above-described embodiments are only examples. Resonators and an evanescent waveguide having different dimensions can be used according to purpose.

Furthermore, in the bandpass filter 110, although the first to third capacitive stubs 123–125 are separately provided on the fourth side surface of the dielectric block 111, they can be connected at the fourth side surface to form a single capacitive stub.

Further, although two-stage bandpass filters 1, 50, 70, 75 and 80 and three-stage bandpass filters 90 and 110 were described, the present invention is not limited to two- and three-stage bandpass filters and can also be applied to four or more staged bandpass filters.

As described above, because the bandpass filter according to the present invention is constituted of the rectangular prismatic dielectric block having no holes or surface irregularities and the metal plates and the exciting electrodes formed on the surfaces thereof, the mechanical strength is extremely high compared with conventional filters. Thus, even if the overall size of the bandpass filter is reduced, sufficient mechanical strength can be ensured. Moreover, because the bandpass filter according to the present invention can be fabricated merely by forming various metal plates and so forth on the dielectric block, and forming of holes or irregularities is not necessary as in conventional filters, the fabrication cost can be substantially reduced.

Moreover, according to the present invention, because the exciting electrodes are disposed on the bottom surface of the dielectric block, a wide band characteristic can be obtained while using a very thin dielectric block.

Further, when the capacitive stubs are provided in the bandpass filter according to the present invention, the overall size of the bandpass filter can be further reduced and radiation loss can be lowered.

Therefore, the present invention provides a bandpass filter that can be preferably utilized in communication terminals such as mobile phones and the like, Wireless LANs (Local Area Networks), and ITS (Intelligent Transport Systems) and the like.

What is claimed is:

1. A bandpass filter comprising a dielectric block having a top surface, a bottom surface and four side surfaces, said dielectric block being constituted of a first portion lying between a first cross-section of the dielectric block and a second cross-section of the dielectric block substantially parallel to the first cross-section and second and third portions divided by the first portion and metal plates formed on one or more of the surfaces of the dielectric block, thereby enabling the first portion of the dielectric block and the metal plates formed thereon to act as an evanescent waveguide, the second portion of the dielectric block and the metal plates formed thereon to act as a first resonator, and the third portion of the dielectric block and the metal plates formed thereon to act as a second resonator, the metal plates including at least one exciting electrode formed on the bottom surface which has the widest area.

2. The bandpass filter as claimed in claim 1, wherein substantially all of side surfaces of the dielectric block substantially parallel to the first cross-section are open ends.

3. The bandpass filter as claimed in claim 1, wherein the dielectric block has a substantially rectangular prismatic shape.

4. The bandpass filter as claimed in claim 1, wherein the exciting electrodes is formed on a corner or its adjacent region of the bottom surface of the dielectric block.

5. A bandpass filter comprising:

a dielectric block having a top surface, a bottom surface, first and second side surfaces opposite to each other and third and fourth side surfaces opposite to each other, the dielectric block being constituted of a first portion lying between a first cross-section of the dielectric block substantially parallel to the first side surface and a second cross-section of the dielectric block substantially parallel to the first cross-section, a second portion lying between the first side surface and the first cross-section, and a third portion lying between the second side surface and the second cross-section;

a first metal plate formed on the top surface of the dielectric block corresponding to the second portion;

a second metal plate formed on the top surface of the dielectric block corresponding to the third portion;

a third metal plate formed on the third side surface of the dielectric block corresponding to the second portion;

a fourth metal plate formed on the third side surface of the dielectric block corresponding to the third portion;

a fifth metal plate formed on the bottom surface of the dielectric block;

a first exciting electrode formed on the bottom surface of the dielectric block corresponding to the second portion; and a second exciting electrode formed on the bottom surface of the dielectric block corresponding to the third portion.

6. The bandpass filter as claimed in claim 5, wherein substantially all of the first and second side surfaces of the dielectric block are open ends.

7. The bandpass filter as claimed in claim 5, further comprising a third exciting electrode formed on the fourth side surface of the dielectric block corresponding to the second portion and a fourth exciting electrode formed on the fourth side surface of the dielectric block corresponding to the third portion, the first and third exciting electrodes being in contact with each other and the second and fourth exciting electrodes being in contact with each other.

8. The bandpass filter as claimed in claim 5, further comprising a capacitive stub formed on the fourth side surface of the dielectric block corresponding to at least the second and third portions.

9. The bandpass filter as claimed in claim 8, wherein the fifth metal plate is in contact with the capacitive stub.

10. The bandpass filter as claimed in claim 5, wherein substantially all of the fourth side surface of the dielectric block is an open end.

11. The bandpass filter as claimed in claim 5, wherein a portion of the fifth metal plate formed on the surface of the second portion of the dielectric block and another portion of the fifth metal plate formed on the surface of the third portion of the dielectric block have the same dimensions.

12. The bandpass filter as claimed in claim 5, wherein the dielectric block has a substantially rectangular prismatic shape.

13. The bandpass filter as claimed in claim 5, wherein the second portion of the dielectric block, the first metal plate, the third metal plate, and a portion of the fifth metal plate formed on the surface of the second portion of the dielectric block are enabled to act as a first quarter-wave dielectric resonator and the third portion of the dielectric block, the second metal plate, the fourth metal plate, and another portion of the fifth metal plate formed on the surface of the third portion of the dielectric block are enabled to act as a second quarter-wave dielectric resonator.

14. A bandpass filter, comprising:

a plurality of quarter-wave dielectric resonators including at least first and second quarter-wave dielectric resonators located in line, each of which is constituted of metal plates formed on a top surface of a dielectric block, a bottom surface of the dielectric block opposite to the first surface, and a side surface of the dielectric block substantially perpendicular to the top and bottom surfaces, an evanescent waveguide interposed between adjacent quarter-wave dielectric resonators;

a first exciting electrode formed on the bottom surface of a portion of the dielectric block corresponding to the first quarter-wave dielectric resonator; and a second exciting electrode formed on the bottom surface of another portion of the dielectric block corresponding to the second quarter-wave dielectric resonator.

15. The bandpass filter as claimed in claim 14, wherein a direct coupling is provided between the first and second exciting electrodes.

16. The bandpass filter as claimed in claim 14, wherein the bandpass filter is substantially a rectangular prism in overall shape.

17. The bandpass filter as claimed in claim 14, wherein substantially all of surfaces of the dielectric block perpendicular to both the first and third surfaces are open ends.

18. The bandpass filter as claimed in claim 14, further comprising a capacitive stub formed on a surface of the dielectric block opposite to the third surface.

* * * * *